US007392176B2

(12) United States Patent
Nishio et al.

(10) Patent No.: US 7,392,176 B2
(45) Date of Patent: Jun. 24, 2008

(54) ENCODING DEVICE, DECODING DEVICE AND AUDIO DATA DISTRIBUTION SYSTEM

(75) Inventors: Kosuke Nishio, Moriguchi (JP); Takeshi Norimatsu, Kobe (JP); Mineo Tsushima, Katano (JP); Naoya Tanaka, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 937 days.

(21) Appl. No.: 10/285,627

(22) Filed: Nov. 1, 2002

(65) Prior Publication Data

US 2003/0088400 A1 May 8, 2003

(30) Foreign Application Priority Data

Nov. 20, 2001 (JP) ..... 2001-337869
Nov. 30, 2001 (JP) ..... 2001-367008
Dec. 14, 2001 (JP) ..... 2001-381807

(51) Int. Cl.
*G10L 19/02* (2006.01)

(52) U.S. Cl. ..... 704/205

(58) Field of Classification Search ..... None
See application file for complete search history.

(56) References Cited

U.S. PATENT DOCUMENTS 3,566,035 A * 2/1971 Noll et al. ..... 704/203
3,622,885 A * 11/1971 Kruszynski et al. ..... 375/260
3,659,051 A * 4/1972 Kalfaian ..... 704/205
3,919,481 A * 11/1975 Kalfaian ..... 704/209
3,967,067 A * 6/1976 Potter ..... 380/41

(Continued)

FOREIGN PATENT DOCUMENTS

JP 63-33025 2/1988

(Continued)

OTHER PUBLICATIONS

McCree, A., entitled "*A 14 KB/S Wideband Speech Coder with a Parametric Highband Model*", 2000 IEEE International Conference on Acoustics, Speech, and Signal Processing. Proceedings (CAT. No. 00CH37100), Jun. 5-9, 2000.

(Continued)

*Primary Examiner*—David D. Knepper
(74) *Attorney, Agent, or Firm*—Wenderoth, Lind & Ponack, L.L.P.

(57) ABSTRACT

An audio data input unit of an encoding device splits an audio data string into contiguous samples of audio data, and a transforming unit transforms the split audio data into spectral data in a frequency domain. A data dividing unit divides the spectral data into a lower frequency band and a higher frequency band at 11.025 kHz (f1) as a boundary. The spectral data in the lower frequency band is quantized and encoded by a first quantizing unit and an encoding unit. A second quantizing unit generates sub information indicating a characteristic of the spectral data in the higher frequency band, and a second encoding unit encodes the sub information. A stream output unit integrates the codes obtained by the first and second encoding units and outputs the integrated one. Here, f1 is a half or less of a sampling frequency f2 at which the audio data string is created.

15 Claims, 24 Drawing Sheets

U.S. PATENT DOCUMENTS

| | | | | | |
|---|---|---|---|---|---|
| 4,039,754 | A | * | 8/1977 | Lokerson | 704/230 |
| 4,058,676 | A | * | 11/1977 | Wilkes et al. | 704/220 |
| 4,158,751 | A | * | 6/1979 | Bode | 704/208 |
| 4,424,415 | A | * | 1/1984 | Lin | 704/209 |
| 4,622,680 | A | * | 11/1986 | Zinser | 375/245 |
| 5,054,072 | A | * | 10/1991 | McAulay et al. | 704/207 |
| 5,479,562 | A | * | 12/1995 | Fielder et al. | 704/229 |
| 5,522,009 | A | | 5/1996 | Laurent | |
| 5,592,584 | A | | 1/1997 | Ferreira et al. | |
| 5,890,110 | A | * | 3/1999 | Gersho et al. | 704/222 |
| 6,097,880 | A | | 8/2000 | Koyata | |
| 6,356,639 | B1 | | 3/2002 | Ishito et al. | |
| 6,678,653 | B1 | | 1/2004 | Tsushima et al. | |
| 6,823,310 | B2 | | 11/2004 | Ishito et al. | |
| 6,826,526 | B1 | | 11/2004 | Norimatsu et al. | |
| 6,904,404 | B1 | | 6/2005 | Norimatsu et al. | |
| 2002/0035407 | A1 | | 3/2002 | Ishito et al. | |
| 2005/0060147 | A1 | | 3/2005 | Norimatsu et al. | |

FOREIGN PATENT DOCUMENTS

| | | |
|---|---|---|
| JP | 6-27998 | 2/1994 |
| JP | 10-65546 | 3/1998 |
| JP | 10-340099 | 12/1998 |
| JP | 11-30998 | 2/1999 |
| JP | 2000-137497 | 5/2000 |
| JP | 2001-148632 | 5/2001 |
| JP | 2001-154698 | 6/2001 |
| JP | 2001-166800 | 6/2001 |
| JP | 2001-188563 | 7/2001 |
| JP | 2001-296893 | 10/2001 |
| WO | 98/57436 | 12/1998 |

OTHER PUBLICATIONS

Bosi, M., et al., entitled "*ISO/IEC MPEG-2 Advanced Audio Coding*", Journal of the Audio Engineering Society, Audio Engineering Society. New York, NY, US, vol. 45, No. 10, Oct. 1, 1997, pp. 789-812.

Taori, R., et al. "*Hi-Bin: An Alternative Approach to Wideband Speech Coding*", 2000 IEEE International Conference on Acoustics, Speech, and Signal Proceeding. Proceedings (CAT. No. 00CH37100), Jun. 5-9, 2000.

McCree, A., et al., entitled "*An Embedded Adaptive Multi-Rate Wideband Speech Coder*", 2001 IEEE International Conference on Acoustics, Speech and Signal Proceeding. Proceedings (CAT. No. 01CH37221), May 7-11, 2001, pp. 761-764, vol. 2.

ISO/IEC JTC1/SC29/WG11 IS 13818-7, "Information technology—Generic coding of moving pictures and associated audio information", Part 7: Advanced Audio Coding (AAC), First edition Dec. 1, 1997.

Co-pending U.S. Appl. No. 10/285,633, filed Nov. 1, 2002, entitled "*Encoding Device and Decoding Device*".

Co-pending U.S. Appl. No. 10/285,609, filed Nov. 1, 2002, entitled "*Encoding Device and Decoding Device*".

Co-pending U.S. Appl. No. 10/140,881, filed May 9, 2002, entitled "*Encoding Device, Decoding Device, and Broadcast System*".

* cited by examiner

Fig. 10A
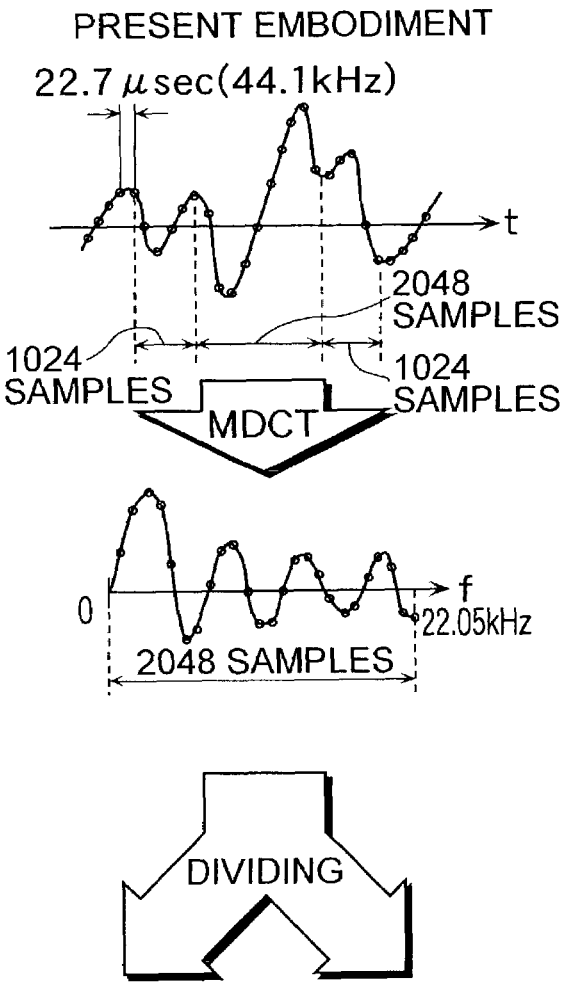
Fig. 10B
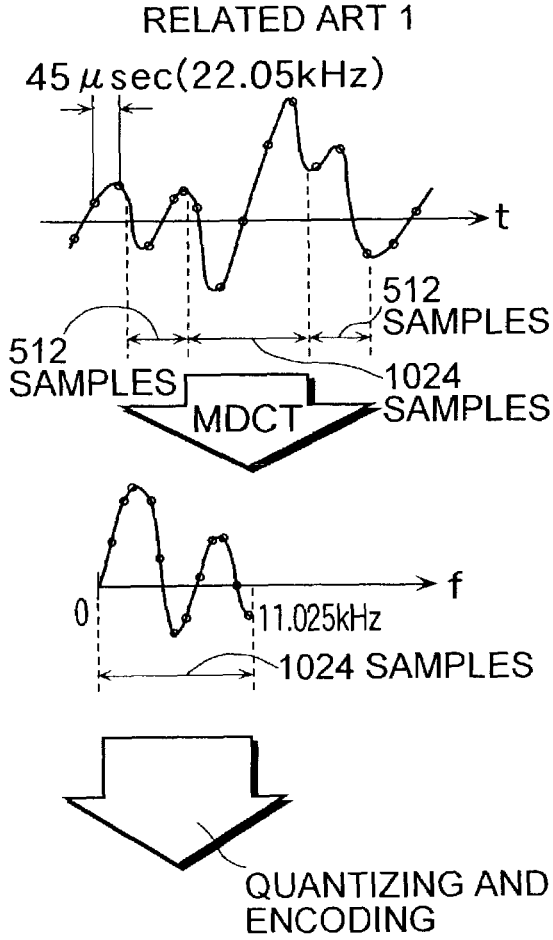
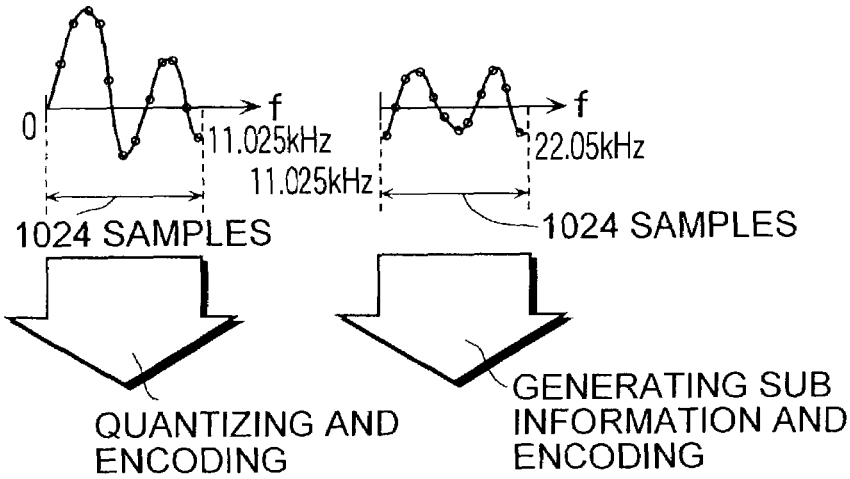

PRESENT EMBODIMENT

RELATED ART 2

Fig. 12

| | PRESENT EMBODIMENT<br>44.1kHz<br>2048 SAMPLES<br>EVERY 2 FRAMES<br>(about 45.4msec) | RELATED ART 1<br>22.05kHz<br>1024 SAMPLES<br>EVERY 1 FRAME<br>(about 45.4msec) | RELATED ART 2<br>44.1kHz<br>1024 SAMPLES<br>Every 1 frame<br>(about 22.7msec) |
|---|---|---|---|
| SPECTRAL DATA | 0~11.025kHz<br>1024 SAMPLES<br>+<br>11.025~22.05kHz<br>SUB INFORMATION | 0~11.025kHz<br>1024 SAMPLES | 0~22.05kHz<br>1024 SAMPLES<br>( 0~11.025kHz<br>512 SAMPLES<br>+<br>11.025~22.05kHz<br>512 SAMPLES ) |
| CHARAC-TERISTICS | VS. RELATED ART 1<br>BANDWIDTH: WIDE<br>SOUND QUALITY: HIGH QUALITY AS A WHOLE<br>BAND OF 0~11.025 kHz: SAME QUALITY<br>BAND OF 11.025~22.05 kHz: WITH SUB INFORMATION<br><br>VS. RELATED ART 2<br>BANDWIDTH: APPROXIMATELY SAME<br>SOUND QUALITY: HIGH QUALITY AS A WHOLE<br>BAND OF 0~11.025 kHz: HIGH QUALITY<br>⇦ HIGH ENCODING EFFICIENCY<br>BAND OF 11.025~22.05 kHz: WITH SUB INFORMATION | VS. PRESENT EMBODIMENT<br>BANDWIDTH: NARROWED BY HALF<br>SOUND QUALITY: LOW QUALITY AS A WHOLE<br>BAND OF 0~11.025 kHz: SAME QUALITY<br>BAND OF 11.025~22.05 kHz: NONE | VS. PRESENT EMBODIMENT<br>BANDWIDTH: APPROXIMATELY SAME<br>SOUND QUALITY: LOW QUALITY AS A WHOLE<br>BAND OF 0~11.025 kHz: LOW QUALITY<br>⇦ LOW ENCODING EFFICIENCY<br>BAND OF 11.025~22.05 kHz: SMALL AMOUNT OF DATA |

ENCODING DEVICE, DECODING DEVICE AND AUDIO DATA DISTRIBUTION SYSTEM

TECHNICAL FIELD

The present invention relates to a technology for compressing/encoding and expanding/decoding audio signals to reproduce high-quality sound.

BACKGROUND ART

In recent years, a variety of audio signal compression/encoding and expansion/decoding methods have been developed. MPEG-2 Advanced Audio Coding (hereinafter referred to as "MPEG-2 AAC" or "AAC") is one of such methods. (See "IS 13818-7 (MPEG-2 Advanced Audio Coding, AAC)" written by M. Bosi, et al., April, 1997.)

FIG. 1 is a block diagram showing a functional structure of an encoding device and a decoding device according to the conventional AAC method.

The encoding device 1000 is a device that compresses and encodes an input audio signal based on AAC encoding method, and includes an A/D converter 1050, an audio data input unit 1100, a transforming unit 1200, a quantizing unit 1400, an encoding unit 1500 and a stream output unit 1900.

The A/D converter 1050 samples an input signal at a sampling frequency of 22.05 kHz, for instance, and converts the analog audio signal into a digital audio data string. Every time the audio input unit 1100 reads 1,024 samples of the audio data string of the input signal (these 1,024 samples are called a "frame" hereinafter), it splits the audio data string into 2,048 samples of data with two sets of a half of the samples for the frame (512) obtained before and after the frame being overlapped.

The transforming unit 1200 performs Modified Discrete Cosine Transform (MDCT) on the data of 2,048 samples in the time domain split by the audio data input unit 1100 into spectral data in the frequency domain. The 1,024 samples of spectral data, a half of the spectral data obtained by the transformation, represent the reproduction bandwidth of 11.025 kHz or less, and are divided into a plurality of groups. Each of the groups is set so as to include one or more samples of spectral data. Also, each of the groups simulates a critical band of human hearing, and is called a "scale factor band".

The quantizing unit 1400 quantizes the spectral data in the scale factor band produced from the transforming unit 1200 into a predetermined number of bits using one normalizing factor for every scale factor band. This normalizing factor is called a "scale factor". Also, the result of quantizing each spectral data with each scale factor is called a "quantized value". The encoding unit 1500 encodes the data quantized by the quantizing unit 1400, that is, each scale factor, and the spectral data quantized using the scale factor, in accordance with Huffman coding.

The stream output unit 1900 transforms the encoding signal produced from the encoding unit 1500 into an AAC bit stream format and outputs it. The bit stream outputted from the encoding device 1000 is transmitted to the encoding device 2000 via a transmission medium or a recording medium.

The encoding device 2000 is a device that decodes the bit stream encoded by the encoding device 1000, and includes a stream input unit 2100, a decoding unit 2200, a dequantizing unit 2300, an inverse-transforming unit 2800, an audio data output unit 2900 and a D/A converter 2950.

The stream input unit 2100 receives the bit stream encoded by the encoding device 1000 via a transmission medium or via a recording medium, and reads out the encoded signal from the received bit stream. The decoding unit 2200 then decodes the Huffman-coded signal to produce quantized data.

The dequantizing unit 2300 dequantizes the quantized data decoded by the decoding unit 2200 using a scale factor. The inverse-transforming unit 2800 performs Inverse Modified Discrete Cosine Transform (IMDCT) on the 1,024 samples of spectral data in the frequency domain produced by the dequantizing unit 2300 into the audio data of 1,024 samples in the time domain. The audio data output unit 2900 combines the audio data of 1,024 samples in the time domain produced by the inverse-transforming unit 2800 in sequence, and outputs the sets of audio data of 1,024 samples in the temporal order one by one. The D/A converter 2950 converts the digital audio data into the analog audio signal at a sampling frequency of 22.05 kHz.

In the above-mentioned encoding device 1000 and the decoding device 2000 according to the conventional AAC standard, each sample data can be compressed to 1 bit or less. In addition, since the spectral data of 1,024 samples in the lower frequency band which represents a reproduction bandwidth of 11.025 kHz or less, a half of the sampling frequency, with higher priority for hearing, are encoded, the audio signal can be reproduced in relatively high quality.

However, in the encoding device 1000 and decoding device 2000 according to the conventional AAC method (Related Art 1), the spectral data to be encoded include no data of the bandwidth over 11.025 kHz because the sampling frequency is 22.05 kHz. Therefore, there is a problem that the request for hearing higher quality sound including the bandwidth over 11.025 kHz cannot be satisfied.

In order to solve this problem, it is considered to raise the sampling frequency applied to the A/D converter 1050 of the encoding device 1000 and the D/A converter 2950 of the decoding device 2000 in FIG. 1 to the double of 22.05, that is, 44.1 kHz (Related Art 2).

However, if the sampling frequency is 44.1 kHz, the spectral data of 512 samples in the higher frequency band over 11.025 kHz can be encoded while keeping a compression ratio, but the spectral data in the lower frequency band with higher priority for hearing is reduced in half, that is, 512 samples. In other words, the sampling frequency and the number of spectral data in the lower frequency is in a trade-off relationship, and both of them cannot be raised at the same time. Therefore, there occurs another problem that the sound quality is deteriorated as a whole.

This kind of problem occurs in the encoding device and the decoding device according to other methods (MP3, AC3, etc., for instance).

The present invention is designed to solve the above-mentioned problems, and the object of the present invention is to provide an encoding device and a decoding device that can realize reproduction of high-quality sound without substantially increasing data amount after encoding.

DISCLOSURE OF INVENTION

In order to achieve the above object, the encoding device according to the present invention is an encoding device that encodes audio data, and includes: a splitting unit operable to split an audio data string into a fixed number of contiguous audio data; a transforming unit operable to transform the split audio data into spectral data in a frequency domain; a dividing unit operable to divide the spectral data obtained by the transforming unit into spectral data in the lower frequency band of f1 Hz and less and spectral data in a higher frequency band over f1 Hz; a lower frequency band encoding unit operable to quantize the divided spectral data in the lower frequency band and encode the quantized data; a sub information generating unit operable to generate sub information indicating a characteristic of a frequency spectrum in the higher frequency band from the divided spectral data in the higher frequency band; a higher frequency band encoding unit operable to encode the generated sub information; and an outputting unit operable to integrate a code obtained by the lower frequency band encoding unit and a code obtained by the higher frequency band encoding unit, and output the integrated code, wherein the f1 is a half or less of a sampling frequency f2 at which the audio data string is created.

In the encoding device according to the present invention, the transforming unit outputs a lot of the spectral data in the lower frequency band of f1 and less out of the audio data split by the splitting unit, and at the same time, outputs the spectral data in the higher frequency band over f1. The spectral data in the lower frequency band divided by the dividing unit is quantized and encoded, and the spectral data in the higher frequency band is encoded into the sub information representing characteristics of the higher frequency band. The higher frequency band encoding unit encodes the generated sub information. Therefore, the audio signal in the higher frequency band can be encoded to reproduce high-quality sound, as well as the audio signal in the lower frequency band can be encoded in the same manner as down-sampling, without substantially increasing the total amount of data.

Here, f1 is f2/4, and the transforming unit may transform the audio data into spectral data of 0~2×f1 Hz, and the dividing unit may divide the spectral data of 0~2×f1 Hz into the spectral data in the lower frequency band of f1 Hz and less and the spectral data in the higher frequency band of over f1 up to 2×f1 Hz. Or, the spectral data in the lower frequency band of f1 and less is comprised of n samples of spectral data, the splitting unit may split the audio data string into audio data of a number required for generating 2×n samples of spectral data, the transforming unit may transform the split audio data into 2×n samples of spectral data, and the dividing unit may divide 2×n samples of the spectral data into n samples of the spectral data in the lower frequency band and n samples of the spectral data in the higher frequency band. Or, the splitting unit may split the audio data string into 2×n samples of spectral data consisting of n samples of audio data which correspond to one frame as an encoding unit as well as two sets of n/2 samples of audio data in two frames adjacent before and after the frame, and the transforming unit may perform MDCT on the split 2×n samples of the audio data into spectrum of 0~2×f1 Hz consisting of 2×n samples of the spectral data.

Furthermore, the decoding device according to the present invention is a decoding device that decodes encoded data inputted via a recording medium or a transmission medium, and includes: an extracting unit operable to extract lower frequency band encoded data and higher frequency band encoded data included in encoded data; a lower frequency band dequantizing unit operable to decode and dequantize the lower frequency band encoded data extracted by the extracting unit, and thereby output spectral data in a lower frequency band of f1 Hz and less; a sub information decoding unit operable to decode the higher frequency band encoded data extracted by the extracting unit, and thereby generate sub information indicating a characteristic of spectral data in a higher frequency band; a higher frequency band dequantizing unit operable to output the spectral data in the higher frequency band based on the sub information generated by the sub information decoding unit; an integrating unit operable to integrate the spectral data in the lower frequency band outputted by the lower frequency band dequantizing unit and the spectral data in the higher frequency band outputted by the higher frequency band dequantizing unit; an inverse-transforming unit operable to inversely transform the spectral data integrated by the integrating unit into audio data in a time domain; an audio data outputting unit operable to output the audio data which is inversely transformed by the inverse-transforming unit on a time series basis.

In the decoding device according to the present invention, the extracting unit extracts the lower frequency band encoded data and the higher frequency band encoded data out of the inputted encoded data, and the lower frequency band dequantizing unit outputs spectral data in the lower frequency band of f1 and less. The sub information decoding unit decodes the sub information, and the higher frequency band dequantizing unit outputs the spectral data in the higher frequency band based on the sub information. Therefore, much more amount of data than the conventional one can be decoded with a very small amount of data almost same as the conventional one, as well as the audio signal can be decoded to reproduce high-quality sound.

Note that the present invention can, of course, be realized as a communication system including the above-mentioned encoding device and decoding device, as an encoding method, a decoding method and a communication method having the steps performed in the characteristic units of the above-mentioned encoding device, decoding device and communication system, as an encoding program and a decoding program causing a CPU to function as the characteristic units of the above-mentioned encoding device, decoding device and communication system or the steps therein, or as a computer-readable recording medium on which these programs are recorded.

BRIEF DESCRIPTION OF DRAWINGS

These and other objects, advantages and features of the invention will become apparent from the following description thereof taken in conjunction with the accompanying drawings that illustrate a specific embodiment of the invention. In the Drawings:

FIGS. 10A and 10B show the comparison of the processing between the encoding device shown in FIG. 2 and Related Art 1.

FIG. 12 shows the comparison of the spectral data and characteristics between the encoding device shown in FIG. 2 and Related Arts 1 and 2.

BEST MODE FOR CARRYING OUT THE INVENTION

The case where the embodiment of the present invention is applied to a broadcast system as an audio data distribution system will be explained with reference to the figures.

Figure 1:
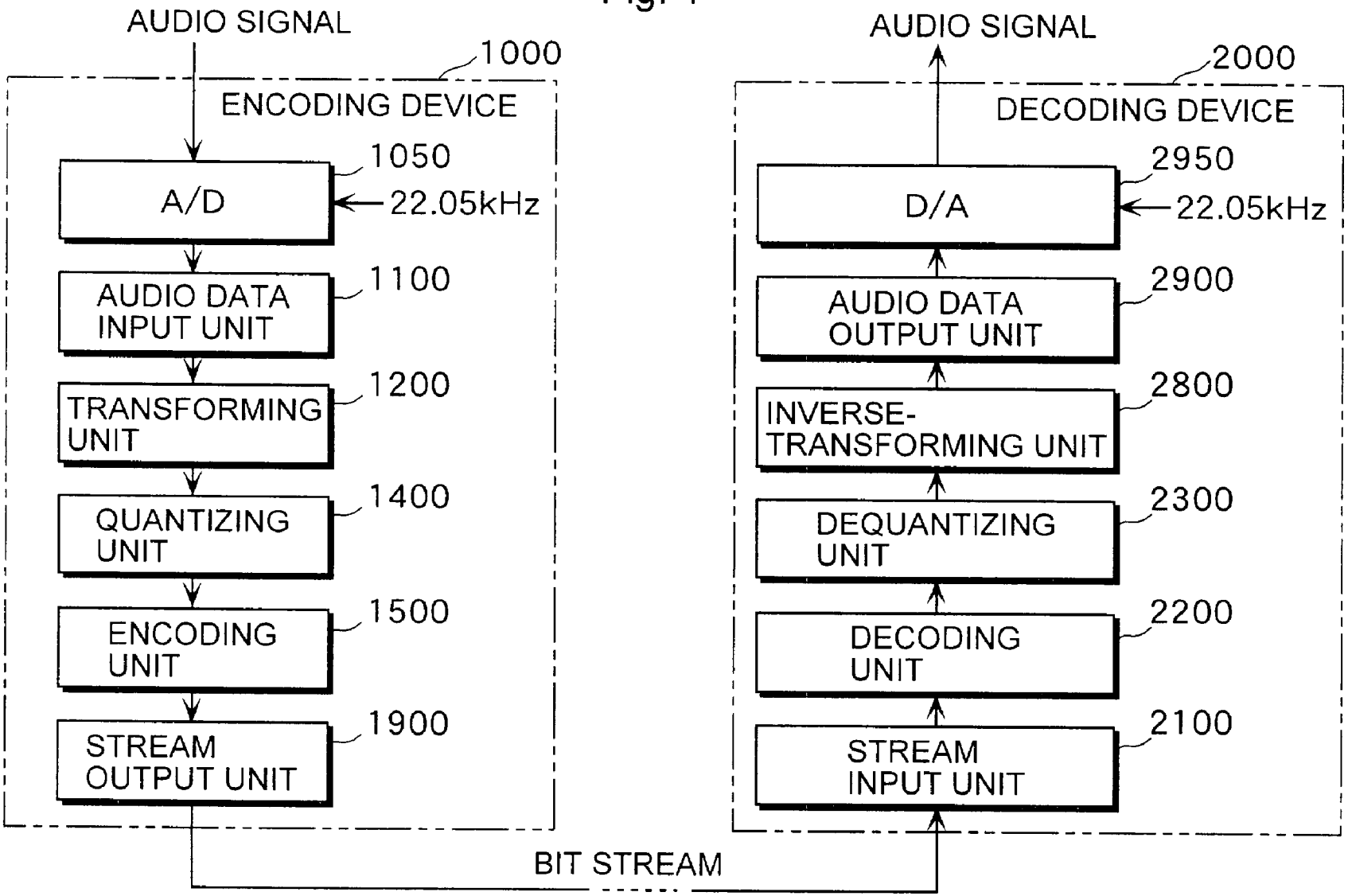
FIG. 1 is a block diagram showing a structure of the encoding device and the decoding device according to the conventional AAC method.
Figure 2:
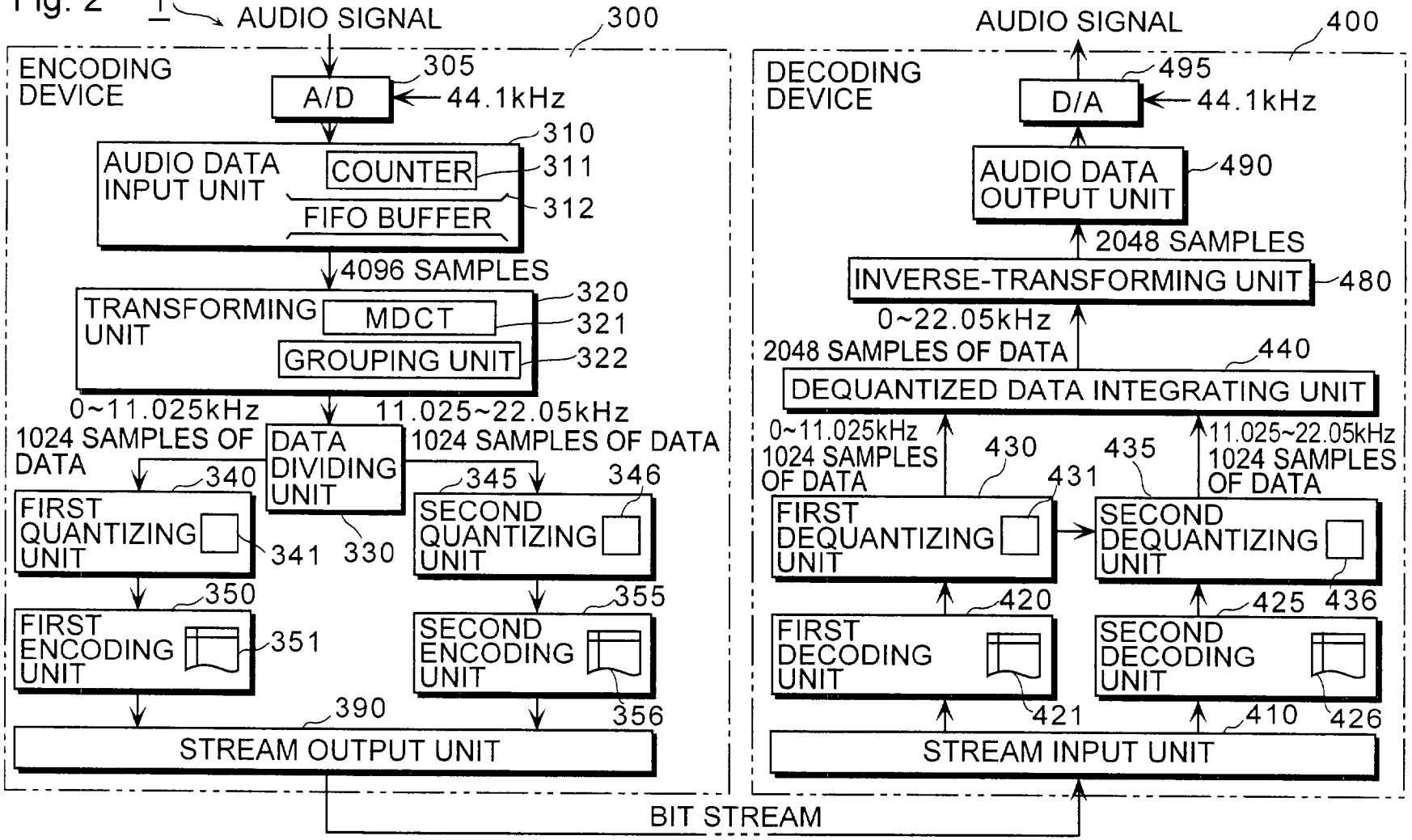
FIG. 2 is a block diagram showing a functional structure of the broadcast system according to the present embodiment.

FIG. 2 is a block diagram showing the functional structure of the broadcast system according to the present invention.

The broadcast system 1 according to the present embodiment as shown in FIG. 2 is placed in a broadcast station, and includes an encoding device 300 that encodes an input audio signal, and a decoding device 400 that decodes the bit stream audio signal encoded by the encoding device 300.

(Encoding Device 300)

The encoding device 300, when receiving an audio signal, encodes the audio signal, and includes an A/D converter 305, an audio data input unit 310, a transforming unit 320, a data dividing unit 330, a first and second quantizing units 340, 345, a first and second encoding unit 350, 355, and a stream output unit 390.

The A/D converter 305 samples the input audio signal at a sampling frequency of 44.1 kHz, twice as high frequency as that in Related Art 1, converts the analog audio signal into the digital audio data (of 16 bits, for instance), and generates an audio data string in the time domain.

The audio data input unit 310, at a sampling frequency (approximately 45.4 μsec) of receiving audio data string of 2,048 samples (2 frames) generated by the A/D converter 305, that is, a twice as slow sampling frequency as usual, splits the audio data string into every audio data string of contiguous 2,048 samples with two sets of 1,024 samples obtained before and after the 1,024 samples being overlapped, that is, twice (4,096 samples) as many as the usual number of samples. The audio data input unit 310 includes a counter 311 for detecting a splitting timing for every receipt of 2,048 samples, and an FIFO buffer 312 for storing the audio data string of 4,096 samples temporarily.

The transforming unit 320 transforms this audio sample data of 4,096 samples of two frames in the time domain split by the audio data input unit 310 into spectral data in the frequency domain. The transforming unit 320 includes an MDCT 321 that transforms the audio data of 4,096 samples in the time domain into the 4,096 samples of spectral data in the frequency domain, and a grouping unit 322 that groups the spectral data for every scale factor band.

In more detail, the MDCT 321 transforms the sample data composed of 4,096 samples in the time domain into the spectral data that also includes 4,096 samples (16 bits). The samples of this spectral data are symmetrically arranged, and therefore only a half (i.e., 2,048 samples) of them is to be encoded and the other half is discarded.

As described above, if the structures of the A/D converter 305, the audio data input unit 310 and the transforming unit 320 in the encoding device 300 are compared with the corresponding units in the encoding device 1000 of Related Art 1, the present embodiment is substantially different from Related Art 1 in that the sampling frequency in the A/D converter 305 is doubled (44.1 kHz), the splitting length in the audio data input unit 310 is doubled (4,096 samples), and the encoding unit in the MDCT 321 of the transforming unit 320 is doubled (4,096 samples).

Also, if the present embodiment is compared with Related Art 2, the former is substantially different from the latter in that the splitting length in the audio data input unit 310 is doubled (4,096 samples) and the encoding unit in the MDCT 321 of the transforming unit 320 is doubled (4,096 samples), although the sampling frequency in the A/D converter 305 is same.

As a result, the transforming unit 320 outputs the 1,024 samples of spectral data belonging to the lower frequency band of 11.025 kHz or less (hereinafter referred to as "spectral data in the lower frequency band"), and the 1,024 samples of spectral data belonging to the higher frequency band over 11.025 kHz ("spectral data in the higher frequency band"), that is, 2,048 samples of spectral data in total.

The grouping unit 322 of the transforming unit 320 groups the spectral data of 2,048 samples to be encoded, into a plurality of scale factor bands, each of which contains spectral data composed of at least one sample (or, practically speaking, samples whose total number is a multiple of four).

According to AAC, the number of samples of spectral data contained in each scale factor band is defined according to its frequencies. A scale factor band of lower frequency band is delimited narrowly by less spectral data, and a scale factor band of a higher frequency band is delimited widely by more spectral data. In AAC, the number of scale factor bands corresponding to spectral data of one frame is also defined according to sampling frequencies. When sampling frequency is 44.1 kHz, for instance, each frame contains 49 scale factor bands, and the 49 scale factor bands contain spectral data of 1,024 samples. On the other hand, it is not particularly defined in AAC which scale factor band is to be transmitted among these scale factor bands, and the most desirable scale factor band, which is selected according to the transmission rate of a transmission channel, may be transmitted. When the transmission rate is 96 kbps, for instance, only the 40 scale factor bands (640 samples) in a lower frequency band in one frame may be selectively transmitted.

On the other hand, in the present embodiment, the spectral data in two frames (1,024 spectral data in the lower frequency band and the higher frequency band, respectively) is outputted from the MDCT 321 at a sampling frequency (approximately 45.4 μsec) twice as fast as the conventional one. Therefore, when the transmission rate of a transmission channel is 96 kbps, even if all the scale factor bands in the lower frequency band (1,024 samples) among the two frames are to be transmitted, there is still sufficient capacity left in the transmission channel, compared with the transmission of two frames (640×2=1,280 samples) according to the conventional AAC. So, the present embodiment will be explained on the assumption that the grouping unit 322 groups the transformed spectral data into scale factor bands whose delimitation and number are uniquely defined.

The data dividing unit 330 divides the 2,048 samples of spectral data outputted from the transforming unit 320 into 1,024 spectral data in the lower frequency band and 1,024 spectral data in the higher frequency band. The data dividing unit 330 outputs the divided 1,024 spectral data in the lower frequency band to the first quantizing unit 340, and the 1,024 spectral data in the higher frequency band to the second quantizing unit 345, respectively.

The first quantizing unit 340 determines a scale factor for the spectral data transferred from the data dividing unit 330 for each scale factor band in the lower frequency band, quantizes the spectrum in the scale factor band with the determined scale factor, and outputs the quantized value that is a quantization result, the determined first scale factor, and the differential between the first and each of the subsequent scale factor, to the first encoding unit 350. The first quantizing unit 340 includes a scale factor calculating unit 341. The scale factor calculating unit 341 calculates one normalizing factor (scale factor, 8 bits) so that the spectral data in each scale factor is within a predetermined number of bits, quantizes each spectrum in the scale factor band using the calculated scale factor, and then calculates the differential between that scale factor and the first scale factor.

The first encoding unit 350 encodes the data quantized by the first quantizing unit 340, the scale factor for each scale factor band, etc. into a predetermined stream format, and includes a Huffman-coding table 351 for further compressing each quantized data, each scale factor, etc. More specifically, the first encoding unit 350 encodes each quantized data, each scale factor, etc. using the Huffman-coding table 351 so as to be transmitted at a low bit rate.

The second quantizing unit 345 calculates the sub information based on the spectral data outputted from the data dividing unit 330 in the bandwidth which is not quantized by the first quantizing unit 340, that is, in higher frequency band of more than 11.025 kHz, and outputs it. The second quantizing unit 345 includes a sub information generating unit 346 for generating the sub information.

Sub information is simplified information that is calculated based on the spectral data in the higher frequency band and indicates concisely the characteristics of the spectral data in the higher frequency band with a little amount of information. In other words, it is information indicating the characteristics of the spectral data in higher frequency band among those obtained by transforming the audio data received for a certain time length. More specifically, the sub information is a scale factor for every scale factor band in the higher frequency band, which derives the quantized value "1" of the absolute maximum spectral data (the spectral data whose absolute value is maximum), and its quantized value.

The second encoding unit 355 encodes the sub information outputted from the second quantizing unit 345 into a predetermined stream format, and outputs the encoded information as second encoded information. The second encoding unit 355 includes a Huffman-coding table 356 for encoding the sub information.

The stream output unit 390 adds header information and other necessary sub information to the above first encoded signal outputted from the first encoding unit 350, and transforms it into an MPEG-2 ACC bit stream, as usual. The stream output unit 390 also records the second encoded signal outputted from the second encoding unit 355 into areas of the above bit stream which are ignored by a conventional decoding device or for which operation is undefined. More specifically, the stream output unit 390 stores the encoded signal outputted from the second encoding unit 355 in Fill Element, Data Stream Element, etc. of the MPEG-2 ACC encoded bit stream.

As for the information indicating the sampling frequency of the bit stream which is stored in the header information, a value of a half of the sampling frequency of the audio data is stored. In other words, when the sampling frequency of the audio data is 44.1 kHz, the information of 22.05 kHz, a half of the actual value is stored. And the information indicating the actual sampling frequency of 44.1 kHz is stored in an area or the like where the above sub information is stored.

The bit stream outputted from the encoding device 300 is transmitted to the decoding device 400 via a transmission medium using a radio wave, an optical cable, a flashing light, a metal wire, etc., such as the Internet.

As described above, when quantizing and encoding the spectral data in the frequency domain obtained by the transforming unit 320, the encoding device 300 divides it into the spectral data (1,024 samples) in the lower frequency band and the spectral data (1,024 samples) in the higher frequency band, quantizes and encodes the spectral data in the lower frequency band in the conventional method, quantizes and encodes the spectral data in the higher frequency in a different method (generates the sub information and encodes the sub information), incorporates the encoded bit stream in the higher frequency band into that in the lower frequency band, and outputs it. The encoding device 300 is substantially different from the conventional encoding device 1000 that quantizes and encodes the spectral data in the same method as a whole.

As a result, the audio signal can be encoded to reproduce high-quality sound without substantially increasing the total amount of information.

Also, since the information that the sampling frequency is 22.05 kHz is stored in the header, there is an effect that the bit stream generated by the encoding device 300 of the present embodiment can also be decoded by the conventional decoding device 2000.

(Decoding Device 400)

The decoding device 400 of the present embodiment is a device that reproduces an audio signal in the time domain (reproduction frequency of 22.05 kHz or less) by performing the processing of the bit stream outputted from the encoding device 300, in the approximately reverse manner to the processing by the encoding device 300. The decoding device 400 includes a stream input unit 410, first and second decoding units 420, 425, first and second dequantizing unit 430, 435, a dequantized data integrating unit 440, an inverse-transforming unit 480, an audio data output unit 490, and a D/A converter 495.

On receiving the bit stream encoded by the encoding device 300 via a transmission medium, the stream input unit 410 selects a first encoded signal stored in an area which is used by a conventional decoding device and a second encoded signal stored in an area which is ignored by the conventional decoding device or for which operation is undefined, and outputs them to the first decoding unit 420 and the second decoding unit 425, respectively.

The first decoding unit 420 receives the first encoded signal outputted from the stream input unit 410, and then decodes it to be reproduced as quantized data, and includes a Huffman-decoding table 421.

The first dequantizing unit 430 dequantizes the quantized data decoded by the first decoding unit 420 and outputs the spectral data, and includes a processing unit 431 for dequantizing the quantized data based on a formula. Here, the number of samples of the spectral data outputted from the first dequantizing unit 430 is 1,024, and they represent the reproduction bandwidth of 11.025 kHz or less.

The second decoding unit 425 receives the second encoded signal outputted from the stream input unit 410 and decodes the sub information, and includes a Huffman-decoding table 426.

The second dequantizing unit 435 generates spectral data in the higher frequency band, and includes a spectral data generating unit 436. Here, the number of samples of the spectral data outputted from the second dequantizing unit 435 is 1,024, and they represent the reproduction bandwidth over 11.025 kHz.

The spectral data generating unit 436 generates noise according to the procedure predetermined based on the spectral data outputted from the first dequantizing unit 430, shapes the noise based on the sub information outputted from the second decoding unit 425, and outputs the spectral data in the higher frequency band. This noise includes white noise, pink noise, and a copy of a part or all of spectral data in the lower frequency band.

More specifically, the spectral data generating unit 436 copies in advance the spectral data in the lower frequency band outputted by the first dequantizing unit 430 into the higher frequency band, and then reconstructs the spectra in the higher frequency band by multiplying each spectral data within the scale factor band by a ratio between the absolute maximum value of the spectral data copied in each band in the higher frequency band and the value obtained by dequantizing the quantized value "1" using the scale factor value corresponding to the band described in the sub information, as a coefficient.

The dequantized data integrating unit 440 integrates the spectral data outputted by the first dequantizing unit 430 and the spectral data outputted by the second dequantizing unit 435. Here, the number of samples of the spectral data outputted by the dequantizing data integrating unit 440 is 2,048, and they represent the reproduction bandwidth of 0~22.05 kHz.

As described above, the decoding device 400 divides the bit stream encoded by the encoding device 300 into the first encoded signal (in the lower frequency band) stored in an area which is used by a conventional decoding device and the second encoded signal (in the higher frequency band) stored in an area which is ignored by a conventional decoding device or for which an operation is undefined, respectively, decodes and dequantizes only the first encoded signal (in the lower frequency band) in the same method as the conventional one, decodes and dequantizes the second encoded signal (in the higher frequency band) in a method different from the conventional one, integrates the spectral data in the higher and lower frequency bands, and outputs the integrated data. In that point, the decoding device 400 is substantially different from the decoding device 2000 of Related Arts 1, 2 that decodes and dequantizes the bit stream over the all bandwidths in the same method.

As a result, much more information than the conventional one can be decoded from a little amount of information approximately same as the conventional one, and therefore the audio signal can be decoded to reproduce high-quality sound.

The inverse-transforming unit 480 performs IMDCT on the spectral data in the frequency domain outputted from the dequantized data integrating unit 440 into the audio data of 2,048 samples (2 frames) in the time domain.

The audio data output unit 490 combines sets of audio data of 2,048 samples in the time domain obtained by the inverse-transforming unit 480 with one another, and outputs them one by one on a time series basis.

The D/A converter 495 converts the digital audio data into the analog audio signal at a sampling frequency of 44.1 kHz.

As mentioned above, the decoding device 400 is substantially different from the decoding device 2000 of Related Art 1 in that the inverse-transformation unit in the inverse-transforming unit 480 is doubled (2,048 samples), the frame length in the audio data output unit 490 is doubled (2,048 samples) and the sampling frequency in the D/A converter 495 is doubled (44.1 kHz).

As a result, an audio signal is outputted to reproduce high-quality sound in the high bandwidth (0~22.05 kHz), based on the spectral data (of 1,024 samples) in the lower frequency band of 11.024 kHz or less and the spectral data (of 1,024 samples) in the higher frequency band.

As described above, according to the functional structure of the present embodiment, an audio signal can be decoded to reproduce high-quality sound by decoding the data in the lower frequency band in the conventional method and decoding the data in the higher frequency with an extremely little amount of information, based on the amount of information approximately same as the conventional one.

Also, in the encoding device 300 and the decoding device 400 of the present embodiment, the data dividing unit 330, the second quantizing unit 345 and the second encoding unit 355 are just added to the conventional encoding device 1000, and the second decoding unit 425, the second dequantizing unit 435 and the dequantizing data integrating unit 440 are just added to the conventional decoding device 2000. Therefore, there is an effect that the encoding device 300 and the decoding device 400 of the present embodiment can be realized without substantially changing the conventional encoding device 1000 and decoding device 2000.

There is also an effect that the bit stream generated by the encoding device 300 of the present embodiment can also be decoded by the conventional decoding device 2000.

Next, encoding processing performed by each unit of the encoding device 300 in the broadcast system 1 will be explained in detail.

Figure 3A:
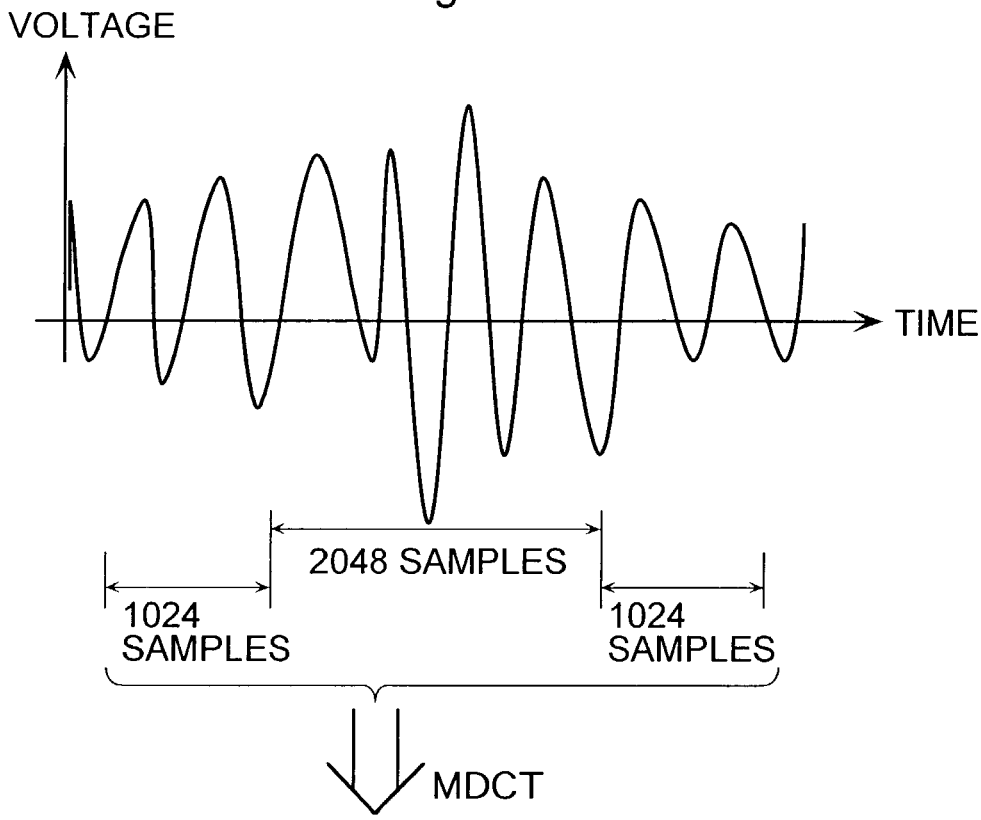
FIGS. 3A and 3B are diagrams showing a state change of an audio signal which is processed in the encoding device shown in FIG. 2.
Figure 3B:
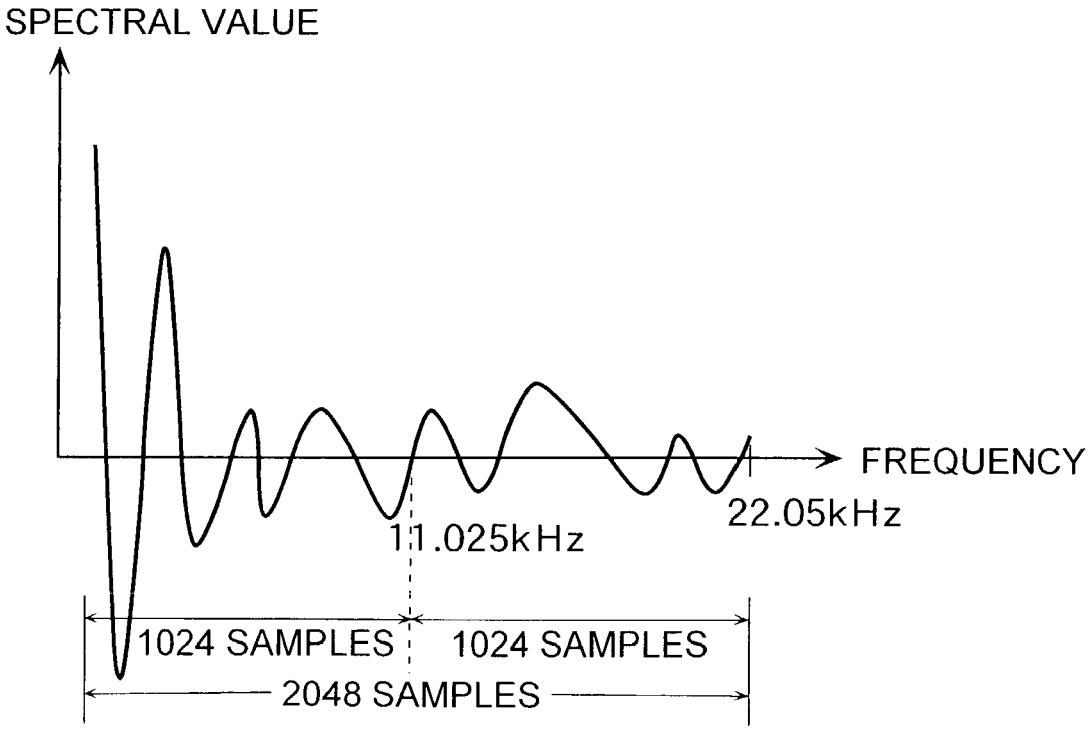

FIG. 3A and FIG. 3B are diagrams showing a state change of an audio signal which is processed in the audio data input unit 310 and the transforming unit 320 of the encoding device 300 shown in FIG. 2. Particularly, FIG. 3A shows a waveform of the 2,048 sample data in the time domain split by the audio data input unit 310 shown in FIG. 2, and FIG. 3B shows a waveform of the spectral data in the frequency domain generated after the sample data in the time domain is transformed by the MDCT 321 of the transforming unit 320 shown in FIG. 2. Note that the sample data and the spectral data are shown as analog waveforms in FIGS. 3A and 3B although they are both digital signals in reality. The same is true in the following diagrams showing waveforms.

The audio data input unit 310 receives audio data sampled at a sampling frequency of 44.1 kHz. From this digital audio signal, the audio data input unit 310 splits the audio data into every contiguous 2,048 samples with two sets of 1,024 samples obtained before and after the 2,048 samples being overlapped, and outputs them to the transforming unit 320.

The transforming unit 320 performs MDCT on the data of 4,096 samples in total. The waveform of the spectral data generated according to MDCT is symmetrically arranged, and therefore only a half of the spectral data corresponding to 2,048 samples is outputted, as shown in FIG. 3B.

In FIG. 3B, the vertical axis indicates the values of frequency spectral data, that is, the amount (size) of the frequency components of the audio data represented in voltage values of the 2,048 samples in FIG. 3A, at 2,048 points corresponding to the number of samples. Since the audio signal inputted into the encoding device 300 is A/D-converted at a sampling frequency of 44.1 kHz, the reproduction bandwidth of the spectral data is 22.05 kHz. Furthermore, since the spectra generated by the MDCT 321 may have negative values as shown in FIG. 3B, the positive and negative signs of the spectra generated by the MDCT 321 also need to be encoded when encoding the spectra. In the following explanation, the information indicating the positive and negative signs of the spectral data is called "sign information".

The spectral data and the sign information outputted from the transforming unit 320 are divided into those in the lower frequency band of 0~11.025 kHz and those in the higher frequency band over 11.025 kHz by the data dividing unit 330, and the spectral data and the sign information in the lower frequency band are outputted to the first quantizing unit 340 and those in the higher frequency band are outputted to the second quantizing unit 345, respectively.

Figure 4:
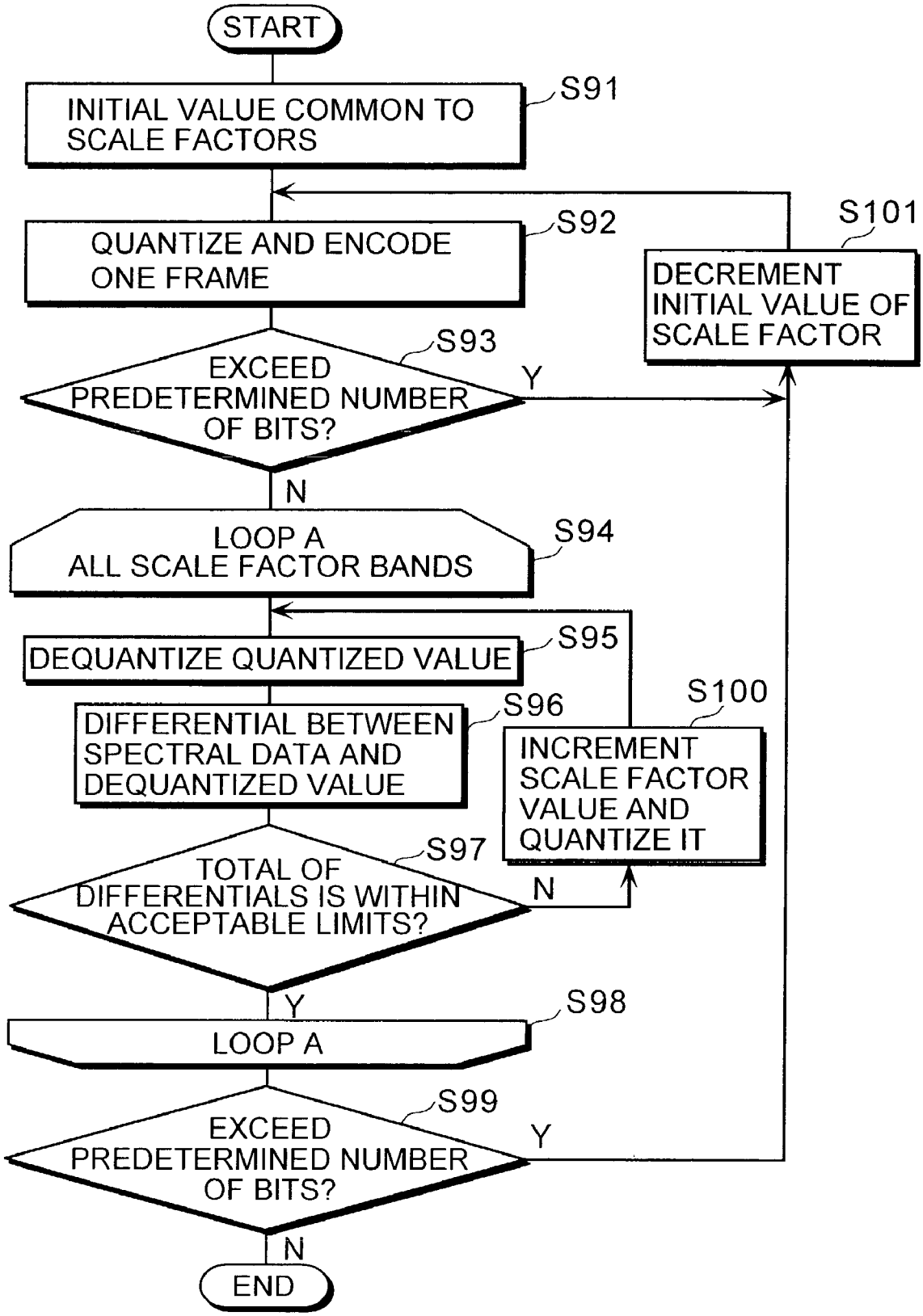
FIG. 4 is a flowchart showing an operation in a scale factor determination processing performed by the first quantizing unit shown in FIG. 2.

FIG. 4 is a flowchart showing an operation in a scale factor determination processing performed by the first quantizing unit 340 shown in FIG. 2.

The first quantizing unit 340 first determines a scale factor common to each scale factor band as an initial value of the scale factor (S91), quantizes all the spectral data in the lower frequency band which are to be transmitted as audio data of one frame (1,024 samples) using the determined scale factor, calculates the differentials between the scale factors before and after the calculated scale factor, and Huffman-codes the differentials, the first scale factor and the quantized values of the spectral data (S92). Note that quantizing and encoding here are performed for only counting the number of bits. Therefore, data only is quantized and encoded, and the information such as a header is not added, in order to simplify the processing.

Next, the first quantizing unit 340 judges whether the number of bits of the Huffman-coded data exceeds a predetermined number of bits or not (S93), and if it exceeds, decrements the initial value of the scale factor (S101). Then, the first quantizing unit 340 quantizes and Huffman-codes the same spectral data in the lower frequency band again using the decremented scale factor value (S92), judges whether the number of bits of the Huffman-coded data in the lower frequency band for one frame exceeds the predetermined number of bits or not (S93), and repeats this processing until it becomes the predetermined number of bits or less.

When the number of bits of the encoded data in the lower frequency band does not exceed the predetermined one, the first quantizing unit 340 repeats the following processing for each scale factor band, and determines the scale factor of each scale factor band (S94). First, it dequantizes each quantized value in the scale factor band (S95), calculates the differentials of the absolute values between the dequantized values and the corresponding original spectral data values, and sums them up (S96). Further, it judges whether the total of the calculated differentials is a value within acceptable limits or not (S97), and if it is within the acceptable limits, repeats the above processing for the next scale factor band (S94~S98).

On the other hand, if it exceeds the acceptable limits, the first quantizing unit 340 increments the scale factor value and quantizes the spectral data of that scale factor band (S100), and dequantizes the quantized value (S95) and sums up the differentials of the absolute values of the dequantized values and the corresponding spectral data values (S96). Furthermore, the first quantizing unit 340 judges whether the total of the differentials is within acceptable limits or not (S97), and if it exceeds the limits, increments the scale factor until it becomes a value within the limits (S100), and repeats the above processing (S95~S97 and S100).

When the first quantizing unit 340 determines, for all the scale factor bands, the scale factors by which the total of the differentials of the absolute values between the dequantized quantized values in the scale factors and the corresponding original spectral data values is within acceptable limits (S98), it quantizes the spectral data in the lower frequency band for one frame again using the determined scale factor, Huffman-codes the differential of each scale factor, the first scale factor and the quantized value of that spectral data, and judges whether the number of bits of the encoded data in the lower frequency band exceeds a predetermined number of bits or not (S99). If the number of bits of the encoded data in the lower frequency band exceeds the predetermined one, the first quantizing unit 340 decrements the initial value of the scale factor until it becomes the predetermined number or less (S101), and then repeats the processing of determining the scale factor in each scale factor band (S94~S98). If the number of bits of the encoded data in the lower frequency band does not exceed the predetermined one (S99), it determines the value of each scale factor at that time to be the scale factor of each scale factor band.

The first quantizing unit 340 quantizes the spectral data in the lower frequency band using the scale factor determined as above, and outputs the quantized value, the first scale factor and the differentials between the determined first scale factor and the following scale factors, as well as the sign information received from the data dividing unit 330, to the first encoding unit 350.

Note that whether the total of the differentials of the absolute values between the dequantized quantized values in the scale factor bands and the original spectral data values is within acceptable limits or not is judged based on the data of psychoacoustic model and so on.

Also, in the above case, a relatively large value is set as an initial value of the scale factor, and when the number of bits of the Huffman-coded data in the lower frequency band exceeds a predetermined number of bits, the initial value of the scale factor is decremented so as to determine the scale factor, but the scale factor need not always be determined in this manner. For example, a lower value is set as an initial value of the scale factor in advance, and the initial value may be gradually incremented. And the scale factor of each scale factor band may be determined using the initial value of the scale factor that has been set just before the total number of bits of the encoded data in the lower frequency band first exceeds a predetermined number of bits.

Furthermore, in the present embodiment, the scale factor of each scale factor band is determined so that the total number of bits of the encoded data in the lower frequency band for one frame does not exceed the predetermined number, but the scale factor needs need not always be determined in this manner. For example, the scale factor may be determined so that each quantized value in the scale factor band does not exceed the predetermined number of bits in each scale factor band. The operation of the first quantizing unit 340 in this processing will be explained below with reference to FIG. 5.

Figure 5:
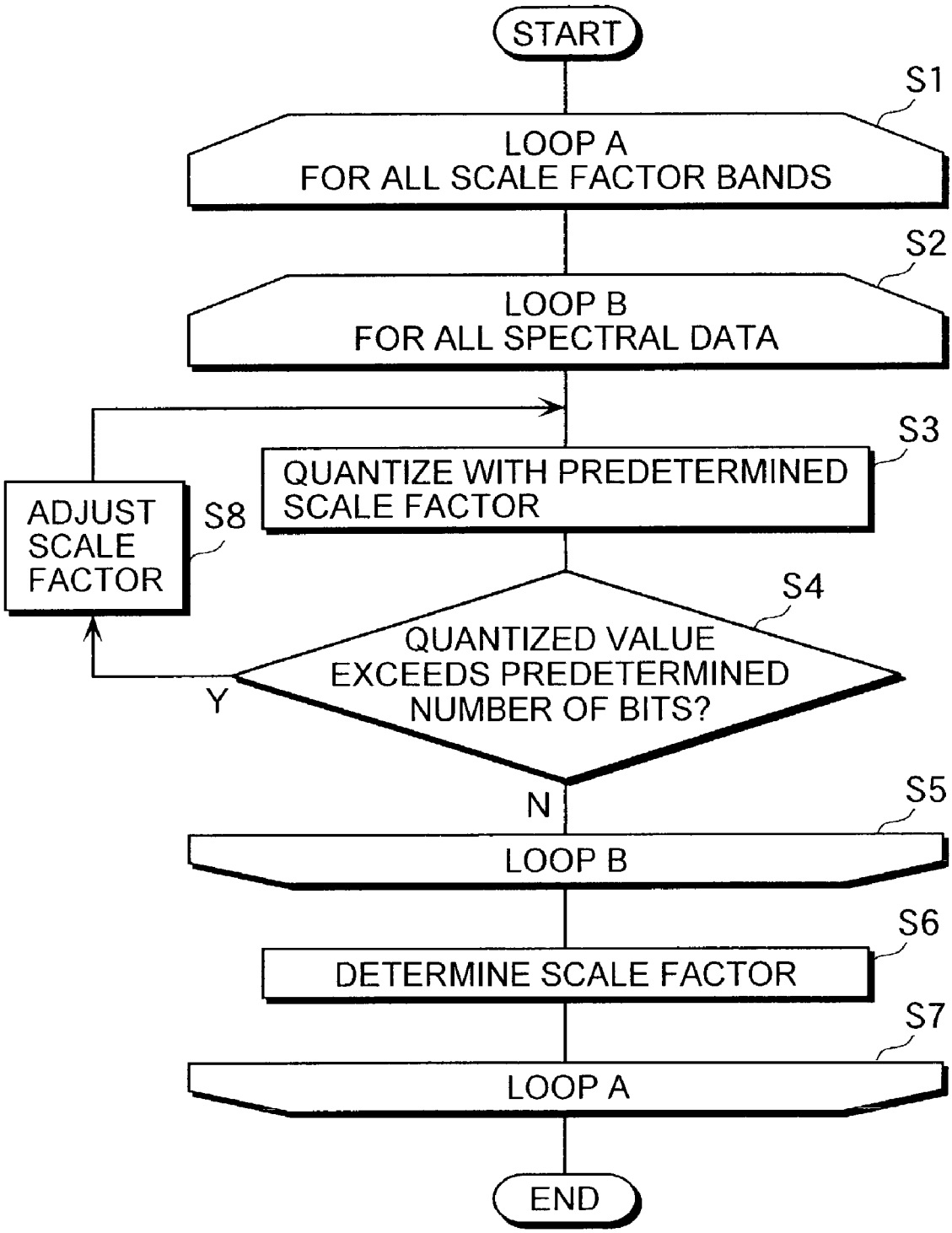
FIG. 5 is a flowchart showing another operation in the scale factor determination processing processed by the first quantizing unit shown in FIG. 2.

FIG. 5 is a flowchart showing an operation in another scale factor determination processing by the first quantizing unit 340 shown in FIG. 2.

The first quantizing unit 340 calculates the scale factors for all the scale factor bands in the lower frequency band to be encoded according to the following procedure (S1). Also, the first quantizing unit 340 calculates the scale factors for all the spectral data in each scale factor band according to the following procedure (S2).

First, the first quantizing unit 340 quantizes the spectral data with a predetermined scale factor value based on a formula (S3), and judges whether the quantized value exceeds a predetermined number of bits given for indicating the quantized value, 4 bits, for instance (S4).

When the quantized value exceeds 4 bits as a result of the judgment, the first quantizing unit 340 adjusts the scale factor value (S8), and quantizes the same spectral data with the adjusted scale factor value (S3). The first quantizing unit 340 judges whether the obtained quantized value exceeds 4 bits or not (S4), and repeats adjustment of the scale factor (S8) and quantization of the adjusted scale factor (S3) until the quantized value of the spectral data becomes 4 bits or less.

When the quantized value is 4 bits or less as a result of the judgment, it quantizes the next spectral data with the predetermined scale factor value (S3).

When the quantized values of all the spectral data in one scale factor band become 4 bits or less (S5), the first quantizing unit 340 determines the scale factor value at that time to be a scale factor for the scale factor band (S6).

After determining the scale factors of all the scale factor bands (S7), the first quantizing unit 340 ends the processing.

According to the above processing, the respective scale factors are determined for all the scale factor bands in the lower frequency band to be encoded. The first quantizing unit 340 quantizes the spectral data in the lower frequency band using the scale factor determined as mentioned above, and outputs the quantized value of 4 bits that is the quantized result, the first scale factor of 8 bits and the differentials between the first scale factor and the following scale factors, as well as the sign information received from the data dividing unit 330, to the first encoding unit 132.

The quantized value, the scale factor and others outputted by the first encoding unit 350 is Huffman-coded, and outputted as the first encoded signal, as in the case of down-sampling, to the stream output unit 390.

On the other hand, the second quantizing unit 345 generates the sub information based on the spectral data in the higher frequency band and so on.

Figure 6:
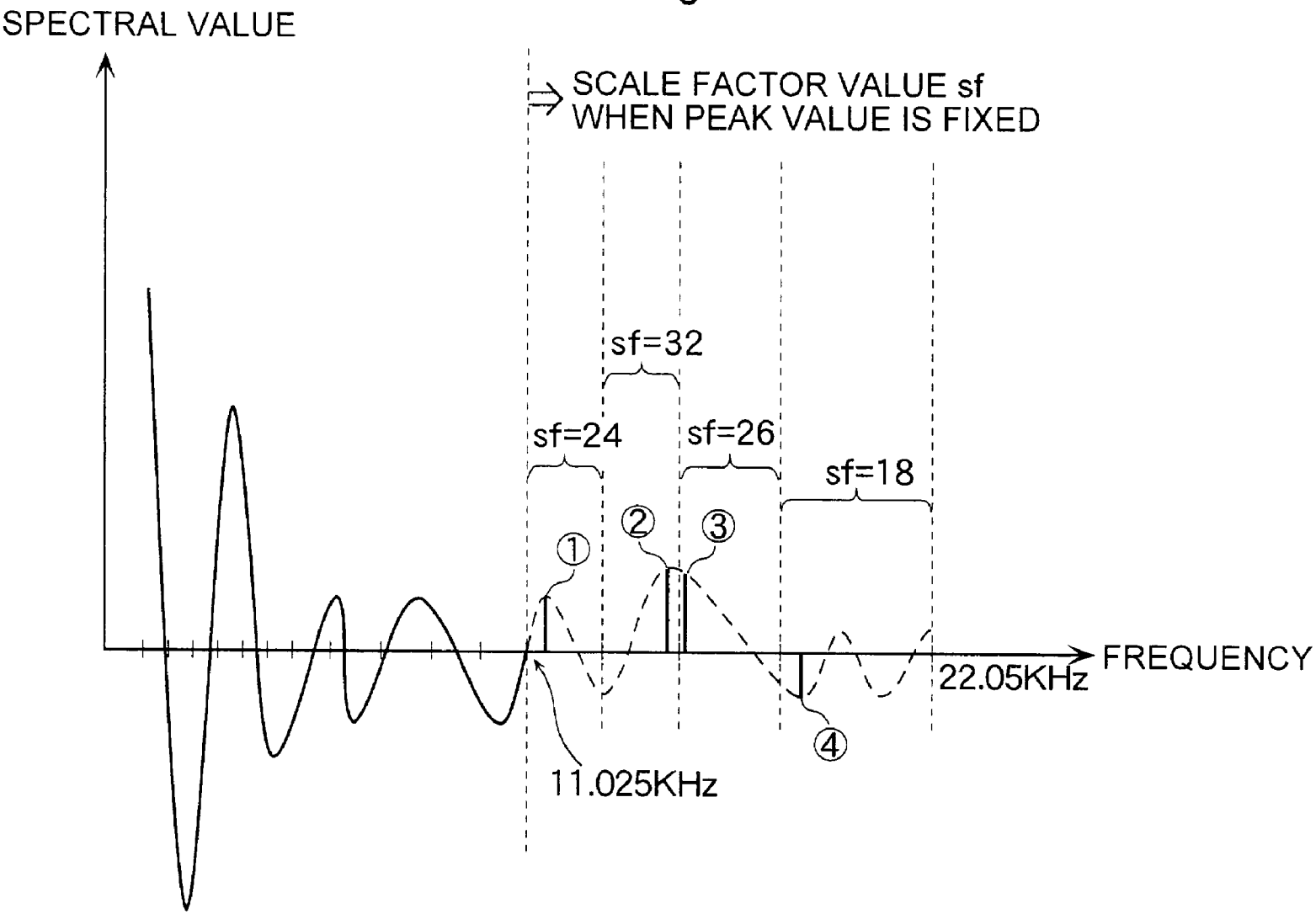
FIG. 6 shows a spectral waveform showing a concrete example of the sub information (scale factor) which is generated by the second quantizing unit shown in FIG. 2.
Figure 7:
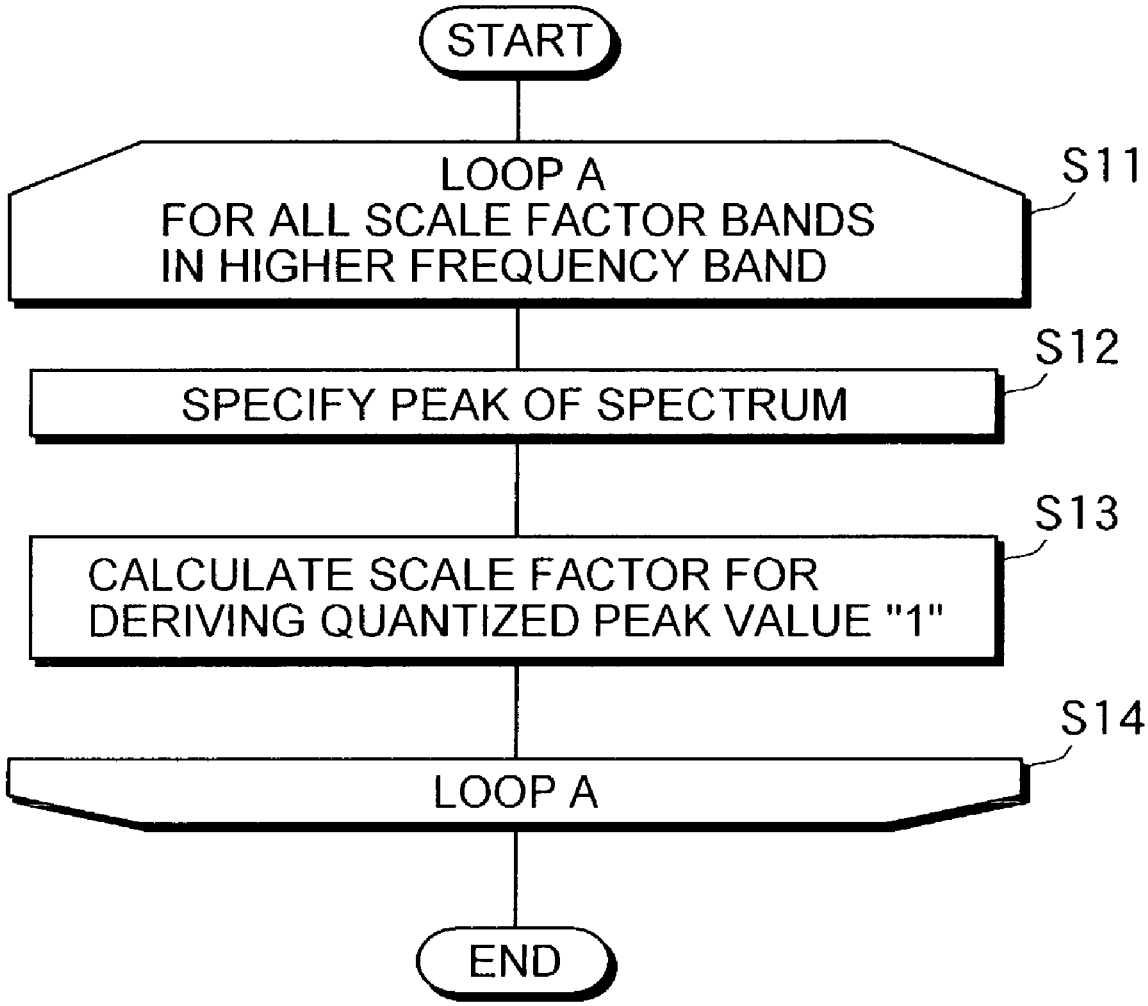
FIG. 7 is a flowchart showing an operation in a sub information (scale factor) calculation processing performed by the second quantizing unit shown in FIG. 2.

FIG. 6 shows a spectral waveform showing a concrete example of the sub information (scale factor) which is generated by the second quantizing unit 345 shown in FIG. 2. FIG. 7 is a flowchart showing an operation in the sub information (scale factor) calculation processing performed by the second quantizing unit 345 shown in FIG. 2.

In FIG. 6, delimiters indicated on the frequency axis in the lower frequency band show those of the scale factor bands determined in the present embodiment. Also, delimiters indicated by a broken line on the frequency axis in the higher frequency band show those of the scale factor bands in the higher frequency band determined in the present embodiment. The same is true on the following waveforms.

Among the spectral data outputted from the transforming unit 320, the reproduction bandwidth in the lower frequency band of 11.025 kHz or less, indicated in a full line waveform in FIG. 6, is outputted to the first quantizing unit 340, and quantized as usual. On the other hand, the reproduction bandwidth in the higher frequency band over 11.025 kHz to 22.05 kHz, indicated in a broken line waveform in FIG. 6, is represented by the sub information (scale factor) calculated by the second quantizing unit 345.

The calculation procedure of the sub information (scale factor) by the second quantizing unit 345 will be explained below according to the flowchart in FIG. 7, using a concrete example of FIG. 6.

The second quantizing unit 345 calculates the optimum scale factor for deriving the quantized value "1" of the absolute maximum spectral data in each scale factor band for every scale factor band in the higher frequency band having the reproduction bandwidth over 11.025 kHz up to 22.05 kHz, according to the following procedure (S11).

The second quantizing unit 345 specifies the absolute maximum spectral data (peak) in the first scale factor band in the higher frequency band having the reproduction bandwidth over 11.025 kHz (S12). In the example of FIG. 6, ① indicates the peak specified in the first scale factor band, and the value of the peak is "256".

According to the same procedure as shown in the flowchart of FIG. 5, the second quantizing unit 345 calculates the scale factor value "sf" for deriving the quantized value "1" obtained from a quantization formula by assigning the peak value "256" and the initial value of the scale factor in the formula (S13). In this case, sf=24 is calculated ("sf" is the scale factor value for deriving the quantized value "1" of the peak value "256"), for instance.

When calculating the scale factor value sf=24 for deriving the quantized peak value "1" for the first scale factor band (S14), the second quantizing unit 345 specifies the peak of the spectral data of the next scale factor band (S12), and if the specified peak position is ② and the value is "312", it calculates the scale factor value for deriving the quantized value "1" of the peak value "312", sf=32, for instance (S13).

In the same manner, the second quantizing unit 345 calculates the scale factor value of the third scale factor band in the higher frequency band for deriving the quantized value "1" of the peak ③ value "288", sf=26, and that of the fourth scale factor band for deriving the quantized value "1" of the peak ④ value "203", sf=18, for instance, respectively.

When calculating the scale factor for every scale factor band in the higher frequency band for deriving the quantized value "1" of the peak value in this way (S14), the second quantizing unit 345 outputs the scale factor of each scale factor band obtained by the calculation to the second encoding unit 355 as the sub information for the higher frequency band, and ends the processing.

The sub information (scale factor) is generated by the second quantizing unit 345, as mentioned above. If this sub information (scale factor) value represented in 1,024 samples of spectral data is represented in numerical values from 0 to 255 for each scale factor band (4 bands in this case) in the higher frequency band, it can be represented in 8 bits. Also, if the differentials from the respective scale factors are Huffman-coded, it is likely that the data amount can be further reduced. On the other hand, if the 1,024 samples of spectral data in the higher frequency band are quantized and Huffman-coded in the conventional method as done for the lower frequency band, it is predicted that the data amount becomes 300 bits at least. Therefore, this sub information just indicates one scale factor for each scale factor band in the higher frequency band, but it is evident that the data amount is substantially reduced compared with the quantization in the higher frequency band in the conventional method.

Also, this scale factor indicates a value approximately proportional to the peak value (absolute value) in each scale factor band, so it can be said that the spectral data of 1,024 samples in the higher frequency band taking a fixed value or the spectral data obtained by multiplying a copy of a part or all of the spectral data in the lower frequency band by scale factors roughly reconstructs the spectral data obtained based on the input audio signals. Also, the spectral data can be reconstructed more accurately by multiplying each spectral data in the band by a ratio between the absolute maximum value of the spectral data copied in the band and the value obtained by dequantizing the quantized value "1" using the scale factor value corresponding to that band, as a coefficient, for every scale factor band. Furthermore, the difference of the waveform in the higher frequency band is not so clearly identified visually as that in the lower frequency band, so the sub information obtained as above is enough as information indicating the waveform in the higher frequency band.

In the present embodiment, the scale factor is calculated so that the quantized value of the spectral data in each scale factor band in the higher frequency band becomes "1", but it does not always need to be "1", and may be another value.

The sub information generated by the second quantizing unit 345 is Huffman-coded by the second encoding unit 355, and stored in an area of the bit stream, which is ignored or for which an operation is undefined in the conventional decoding device, by the stream output unit 390 as the second encoded signal.

Figure 8A:
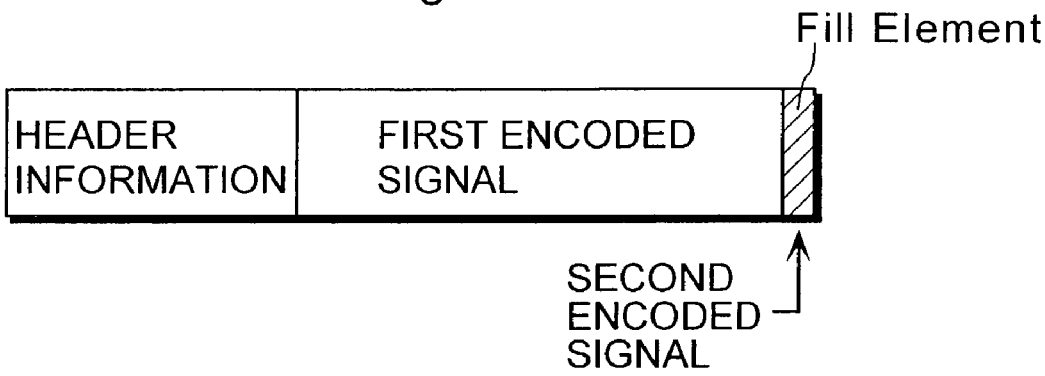
FIGS. 8A~8C are diagrams showing areas of bit streams in which the sub information is stored by the stream output unit shown in FIG. 2.
Figure 8B:
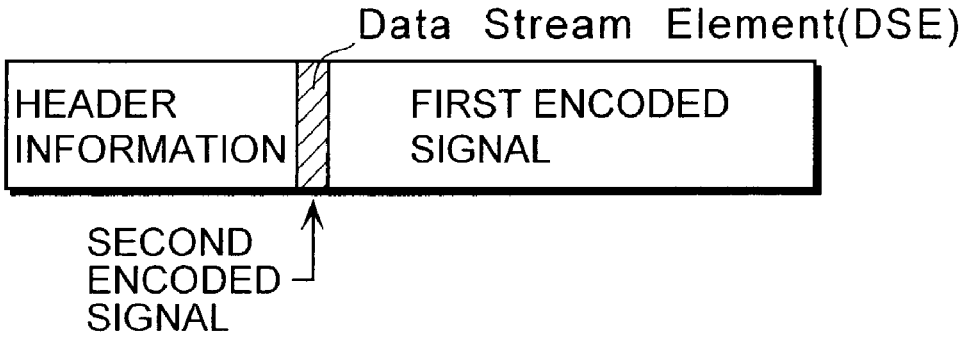
Figure 8C:
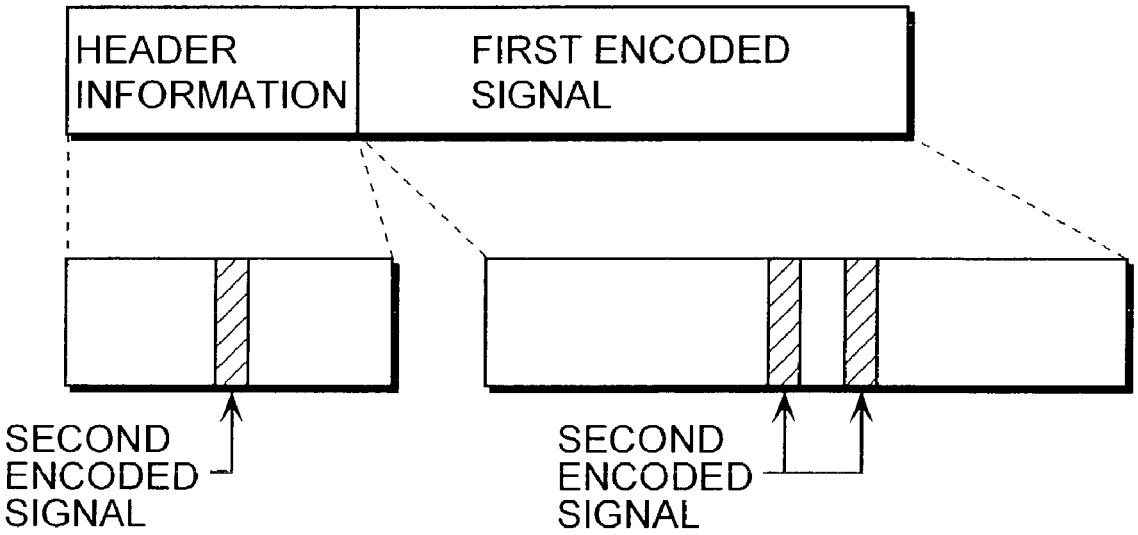

FIGS. 8A~8C are diagrams showing areas in bit streams in which the sub information are stored by the stream output unit 390 shown in FIG. 2. In these figures, the sub information indicating the spectra in the higher frequency band is encoded, and then stored as a second encoded signal in an area where it is not recognized by the conventional decoding device as an audio encoded signal in the bit stream.

In FIG. 8A, a shaded part is an area called Fill Element, which is filled with "0" in order to uniform data length of bit stream. Even if the sub information indicating the spectrum in the higher frequency band, that is, the second encoded signal, is stored in this area, it is not recognized as an encoded signal to be decoded and is ignored in the conventional decoding device 2000.

In FIG. 8B, a shaded part is an area called Data Stream Element (DSE), for instance. This area is provided in anticipation of future extension for MPEG-2 AAC, and only its physical structure is defined in MPEG-2 AAC. As in Fill Element, even if the sub information indicating the spectra in the higher frequency band is stored in this area, the conventional decoding device 2000 ignores it, or does not perform any operations in response to the read information since operation that should be performed by the conventional decoding device 2000 is not defined.

In the above explanation, the second encoded signal is stored in an area, contained in an MPEG-2 AAC bit stream, that is ignored by the conventional decoding device 2000. However, the second encoded signal may be integrated into a predetermined area within the header information, or into a predetermined area of the first encoded signal, or into both the header and the first encoded signal. It is not necessary to secure contiguous areas in the header and the first encoded signal for storing the second encoded signal in the bit stream. For instance, the second encoded signal may be integrated discretely between the header information and the first encoded information, as shown in FIG. 8C.

Figure 9A:
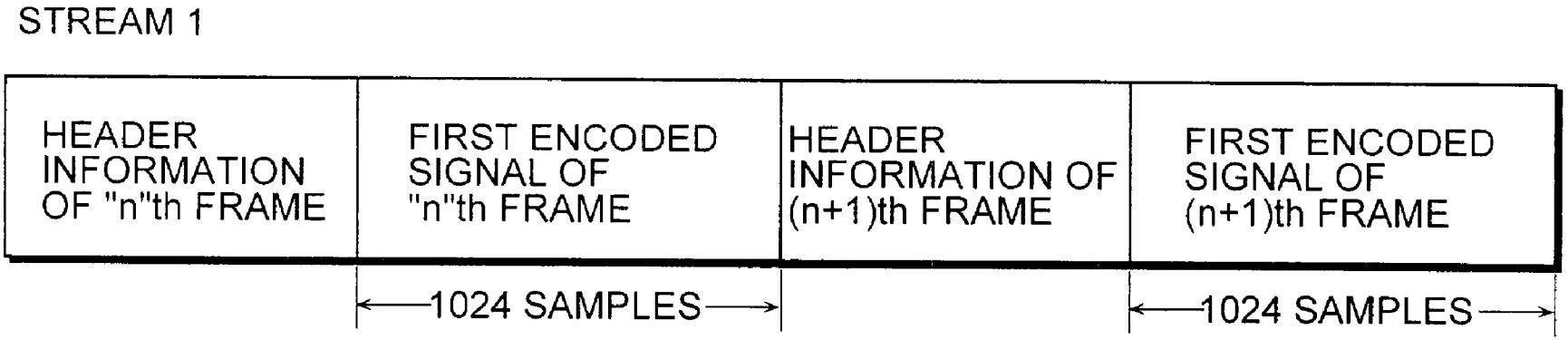
FIGS. 9A and 9B are diagrams showing other examples of areas of bit streams in which the sub information is stored by the stream output unit shown in FIG. 2.
Figure 9B:
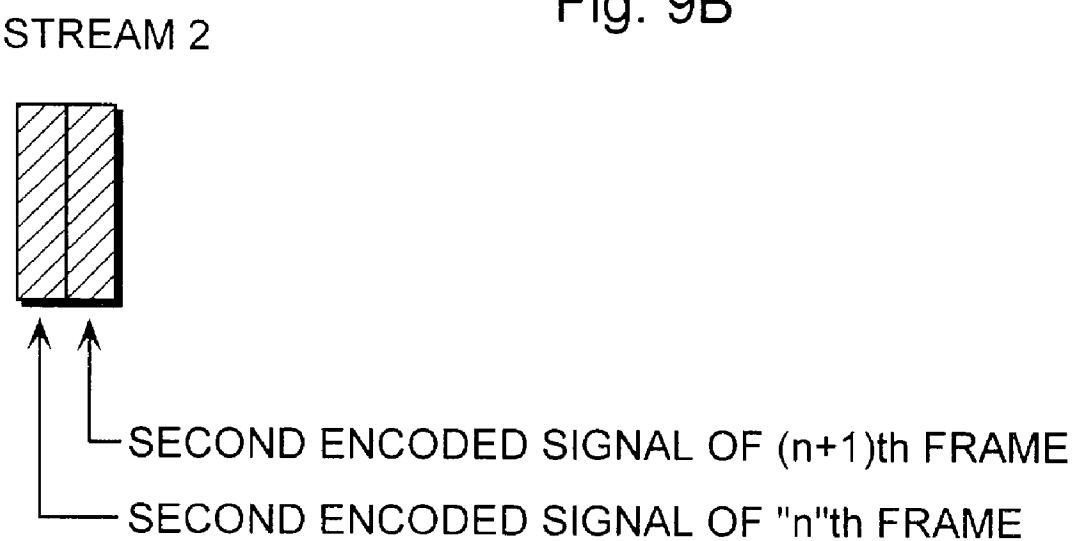

FIG. 9A and FIG. 9B are diagrams showing other examples of areas of bit streams in which the sub information is stored by the stream output unit 390 shown in FIG. 2. FIG. 9A shows a stream 1 in which only the first encoded signal is stored contiguously in each frame. FIG. 9B shows a stream 2 in which only the second encoded signal, that is, the encoded sub information, is stored contiguously in each frame corresponding to the stream 1.

The stream output unit 390 may store the second encoded signal in the stream 2 which is completely different from the stream 1 in which the first encoded signal is stored. The stream 1 and the stream 2 are bit streams which are transmitted via different channels, for instance.

As mentioned above, since the lower frequency band indicating the basic information of the input audio signal is transmitted or stored in advance by transmitting the first and second encoded signals in completely different bit streams, there is an effect that the information for the higher frequency band can be added later if necessary.

In the format shown in FIGS. 8A, 8B and FIGS. 9A, 9B, the information indicating 22.05 kHz which is a half of the actual sampling frequency is stored in the information indicating the sampling frequency for the bit stream which is to be stored in the header. Thereby, even the decoding device 2000 of Related Art 1 can decode the bit stream in the frequency band of 0~11.025 kHz and reproduce it as in the case of down-sampling.

The differences between the method of the encoding device 300 according to the embodiment of the present invention and the method of the encoding device 1000 of Related Art 1 will be explained with reference to FIGS. 10A and 10B. FIGS. 10A and 10B show a comparison between the method of the present embodiment and the method of Related Art 1. Specifically, FIG. 10A shows the method of the present embodiment, and FIG. 10B shows the method of Related Art 1.

According to the method of the present embodiment, an audio data string is acquired at every 22.7 μsec at a sampling frequency of 44.1 kHz, the data of 4,096 samples in total, that is, 2,048 samples contained in a frame to be encoded and two sets of 1,024 samples (i.e., one set of 1,024 samples before and one set of 1,024 samples after the frame), are split and MDCT is performed resulting in 2,048 samples of spectral data. The reproduction bandwidth of this spectral data represents 22.05 kHz. These 2,048 samples of spectral data are divided into the spectral data (of 1,024 samples) in the lower frequency band and the spectral data (of 1,024 samples) in the higher frequency band with 11.025 kHz as a boundary. The spectral data (of 1,024 samples) in the lower frequency band are quantized and encoded as usual, and the first encoded signal with high quality and at a low bit rate as down-sampling is produced. And the 1,024 samples of spectral data in the higher frequency are also produced. If these data are quantized and encoded as usual, a low bit rate cannot be realized. Accordingly, in the method of the present embodiment, the sub information is generated based on the 1,024 samples of spectral data in the higher frequency band, and the second encoded signal is produced by encoding the sub information only. Therefore, an audio signal can be encoded to reproduce high-quality sound without substantially increasing the total amount of information.

On the other hand, in the method of down-sampling by Related Art 1, an audio data string is acquired at every 45 μsec at a sampling frequency of 22.05 kHz, the data of 2,048 samples in total, that is, 1,024 samples contained in a frame to be encoded and two sets of 512 samples (i.e., one set of 512 samples before and one set of 512 samples after the frame), are split and MDCT is performed resulting in, 1,024 samples of spectral data. The reproduction bandwidth of this spectral data represents 11.025 kHz. These 1,024 samples of spectral data are quantized and encoded as usual. Therefore, high-quality encoded signal in the bandwidth of 11.025 kHz or less can be acquired, but the encoded signal in the higher frequency band over 11.025 kHz cannot be acquired because there is no spectral data in the higher frequency band.

Next, the differences between the method of the encoding device 300 of the present embodiment and the method of the encoding device of Related Art 2 will be explained with reference to FIG. 11A and FIG. 11B.

Figure 11A:
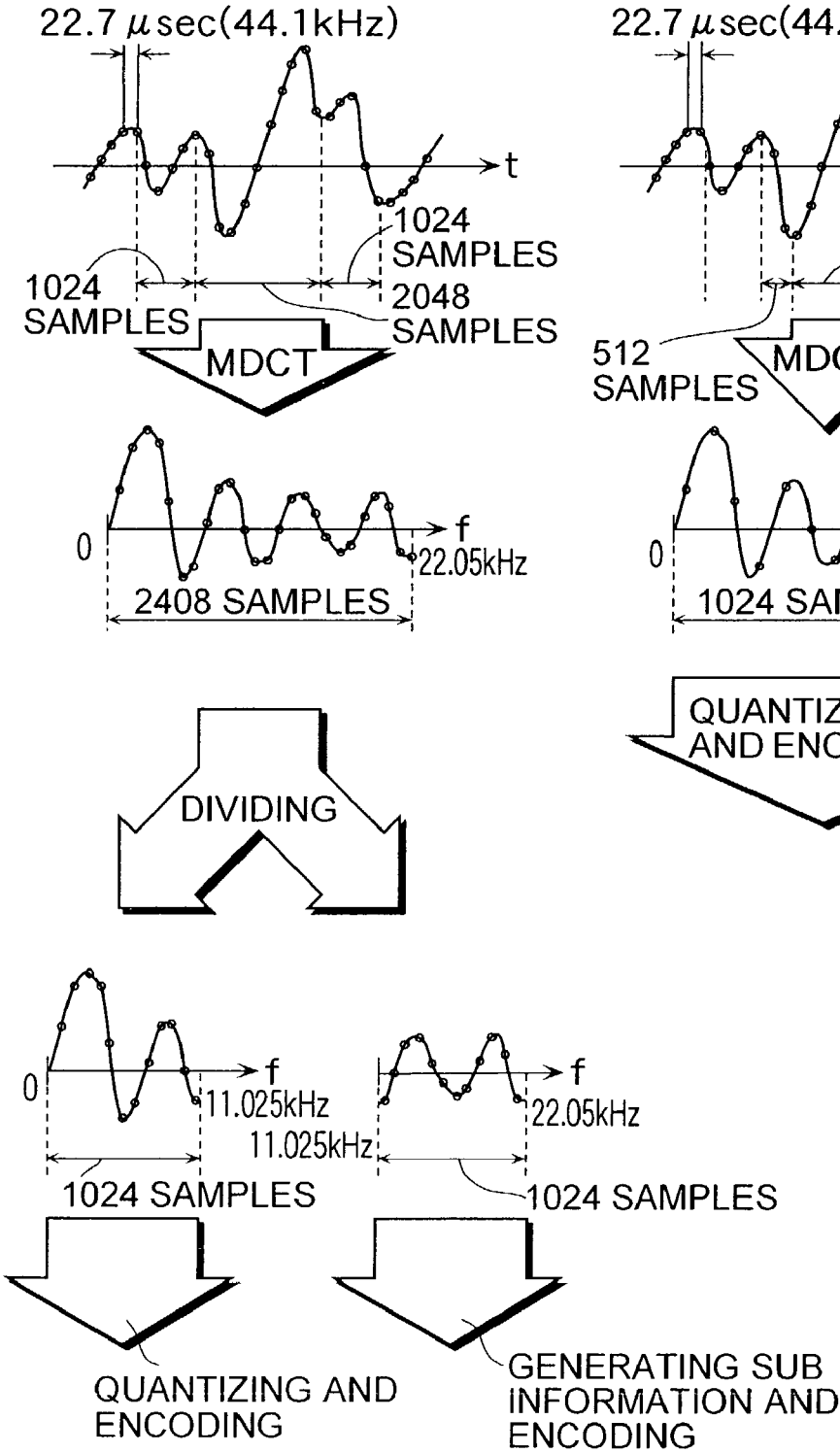
FIGS. 11A and 11B show the comparison of the processing between the encoding device shown in FIG. 2 and Related Art 2.
Figure 11B:
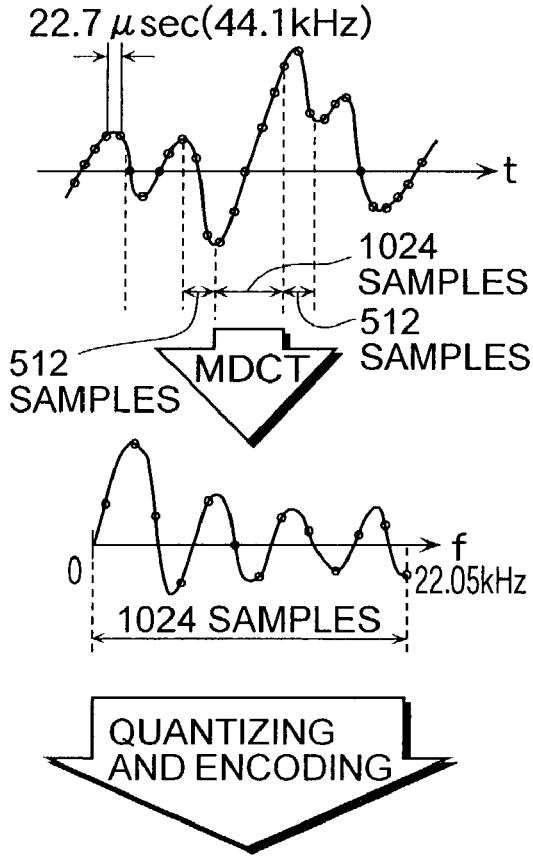

FIG. 11A and FIG. 11B show a comparison between the method of the present embodiment and the method of Related Art 2. Particularly, FIG. 11A shows the method of the present embodiment, and FIG. 11B shows the method of Related Art 2. Since the method of the present embodiment has been explained above, the explanation thereof will be omitted.

In the method of sampling by Related Art 2, an audio data string is acquired at every 22.7 μsec at a sampling frequency of 44.1 kHz, the data of 2,048 samples in total, that is, 1,024 samples contained in a frame to be encoded and two sets of 512 samples (i.e., one set of 512 samples before and one set of 512 after the frame), are split and MDCT is performed resulting in 1,024 samples of spectral data. The reproduction bandwidth of this spectral data represents 22.05 kHz. These 1,024 samples of spectral data are quantized and encoded as usual. In other words, 1,024 samples of spectral data (512 in the lower frequency band of 11.025 kHz or less and 512 in the higher frequency band over 11.025 kHz) are acquired at every half a time length of the present embodiment (22.7 μsec).

Here, assume that, in the encoding device 1000 of the Related Art 2, the sub information is generated from the spectral data in the higher frequency band over 11.025~22.05 kHz, as in the same case of the embodiment of the present invention. In this case, when the number of bits which can be used in quantization at every about 22.7 μsec is "n" and the number of bits which can be used as the sub information is "m1", 512 samples in the lower frequency band (0~11.025 kHz) need to be quantized with (n−m1) bits. On the other hand, in the present embodiment, when the number of bits which can be used in quantization at every about 45.4 μsec is "2×n" and the number of bits which can be used as the sub information is "m2", 1,024 samples in the lower frequency band (0~11.025 kHz) may be quantized with (2×n−m2) bits.

It is generally known that, according to AAC, high encoding efficiency cannot be achieved unless a certain number or more samples are obtained. 512 samples in the Related Art 2 do not reach a threshold value, while 1,024 samples in the present embodiment exceed the threshold value sufficiently.

Accordingly, higher encoding efficiency can be achieved if 1,024 samples are quantized with (2n−m2) bits according to the present embodiment, rather than 512 samples quantized with (n−m1) bits according to the Related Art 2. Also, since the higher encoding efficiency can be achieved in the present embodiment, "m2" can be larger (m2>2×m1), and thereby the sound quality in the higher frequency band can be improved.

FIG. 12 shows a comparison between the spectral data and characteristics in the encoding method of the present embodiment and those in Related Arts 1 and 2.

In the present embodiment, the sampling frequency is 44.1 kHz and the frame length is 2,048 samples. Therefore, 1,024 samples of spectral data in the lower frequency band of 0~11.025 kHz and the sub information based on the 1,024 spectral data in the higher frequency band are acquired. As a result, the bandwidth is approximately the same as that of Related Art 2 but wider than that of Related Art 1. And, the sound quality is same as that of Related Art 1 in the lower frequency band of 0~11.025 kHz, but higher than Related Art 1 as a whole in the higher frequency band over 11.025 kHz because there is the sub information there. In addition, the sound quality in the present embodiment is approximately the same as that of Related Art 2 in the higher frequency band over 11.025~22.05 kHz because of the sub information, and higher in the lower frequency band of 0~11.025 kHz because the number of spectral data is doubled. Therefore, the sound quality in the present embodiment is higher as a whole.

On the other hand, in Related Art 1, the sampling frequency is 22.05 kHz and the frame length is 1,024 samples. 1,024 samples of spectral data are acquired in the lower frequency band of 0~11.025 kHz. As a result, the bandwidth of Related Art 1 is narrower and a half of that of the present embodiment. Therefore, the sound quality is same as that of the present embodiment in the lower frequency band of 0~11.025 kHz, but lower than the present embodiment in the higher frequency band over 11.025~22.05 kHz because there is no spectral data there. Therefore, the sound quality in the Related Art 1 is lower as a whole.

Also, in Related Art 2, the sampling frequency is 44.1 kHz and the frame length is 1,024 samples. 1,024 samples of spectral data are acquired over the entire frequency band of 0~22.05 kHz. As a result, the bandwidth of Related Art 2 is same as that of the present embodiment, but the sound quality is deteriorated and lower than that of the present embodiment in the lower frequency band of 0~11.025 kHz because the number of the spectral data is reduced in half, although it is higher than that of the present embodiment in the higher frequency band of 11.025~22.05 kHz because the spectral data is encoded. Therefore, the sound quality in the Related Art 2 is lower as a whole.

Therefore, according to the present embodiment, by encoding the data in the lower frequency band as usual and encoding the data in the higher frequency band with a very little amount of information, an audio signal can be encoded to reproduce high-quality sound without substantially increasing the total amount of information than before.

Next, encoding processing of each unit of the decoding device 400 in the broadcast system 1 will be explained in detail.

The first encoded signal outputted from the stream input unit 410 is decoded into the quantized data and so on by the first decoding unit 420, and encoded into the spectral data in the lower frequency band by the first dequantizing unit 430. On the other hand, the second decoded signal outputted from the stream input unit 410 is decoded into the sub information by the second decoding unit 425. The second dequantizing unit 435 generates the spectral data in the higher frequency band based on the sub information. The processing in the second dequantizing unit 435 will be explained in detail.

Figure 13:
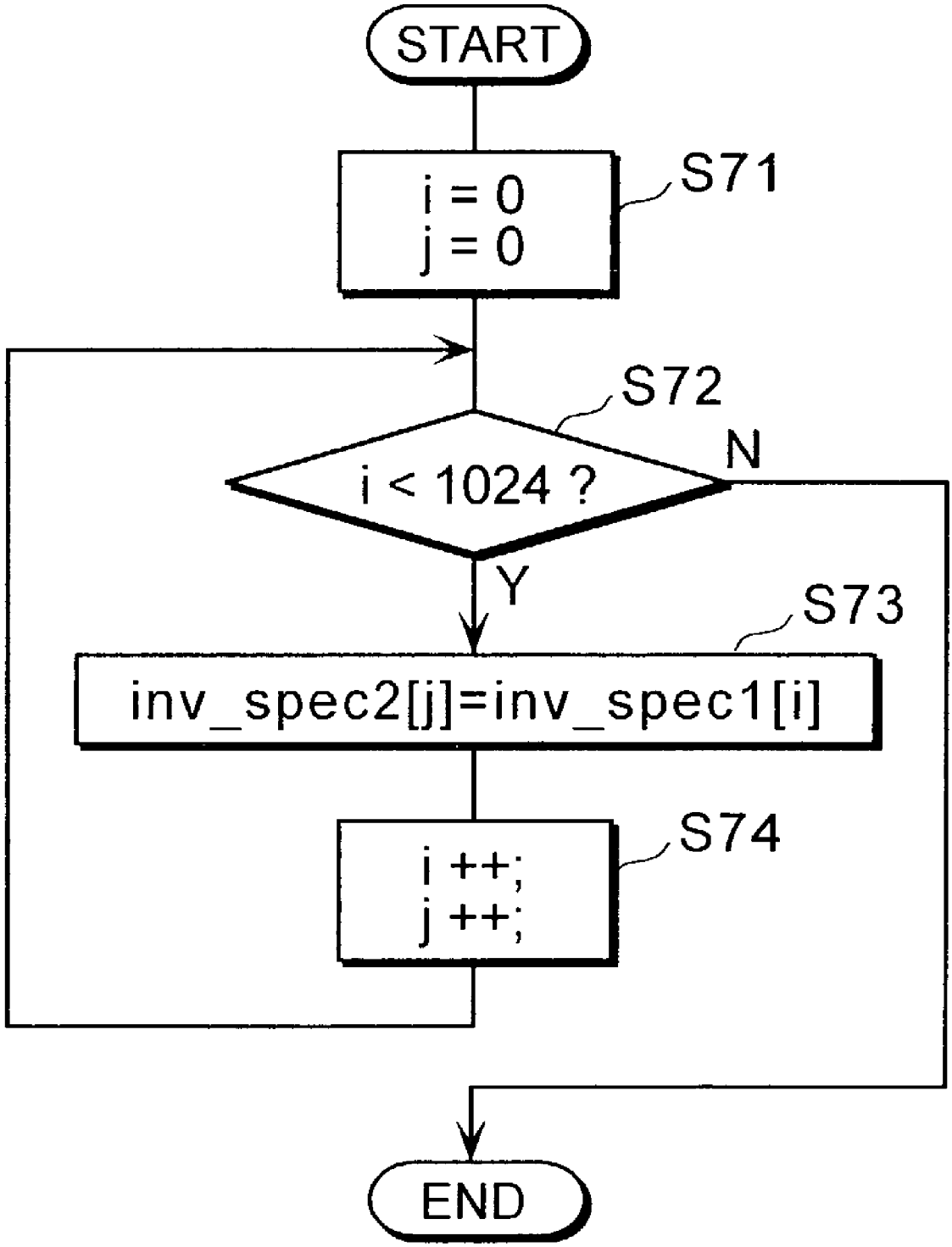
FIG. 13 is a flowchart showing the procedure by which the second dequantizing unit shown in FIG. 2 copies 1,024 spectral data in the lower frequency band to the higher frequency band in the forward direction.

FIG. 13 is a flowchart showing a procedure by which the second dequantizing unit 435 shown in FIG. 2 copies a spectrum of 1,024 samples in the lower frequency band to the higher frequency band in the forward direction. The spectral data in the lower frequency band is copied when the spectral data in the higher frequency band is generated.

In FIG. 13, inv_spec1[i] indicates a value of the ith spectrum among the output data from the first dequantizing unit 430, and inv_spec2[j] indicates a value of the jth spectrum among the input data of the second dequantizing unit 435.

First, the second dequantizing unit 435 sets the initial value of a counter i and a counter j to be "0", which count the number of spectral data, in order to input the spectral data of 0th through 1,023rd in the same direction (S71). Next, the second dequantizing unit 435 checks whether the value of the counter i is less than "1,024" or not (S72). When the value of the counter i is less than "1,024", the second dequantizing unit 435 inputs the value of the ith (0th in this case) spectral data in the lower frequency band of the first dequantizing unit 430 as the value of the jth (0th in this case) spectral data in the higher frequency band of the second dequantizing unit 435 (S73). Then, the second dequantizing unit 435 increments the values of the counters i and j by "1" respectively (S74), and checks whether the value of the counter i is less than "1,024" or not (S72).

The second dequantizing unit 435 repeats the above processing while the value of the counter i is less than "1,024", and ends the processing when the value becomes "1,024" or more.

As a result, all the 0th~1,023rd spectral data in the lower frequency band that are the results of dequantization by the first dequantizing unit 430 are copied as they are as the spectral data in the higher frequency band of the second dequantizing unit 435.

The amplitude of the spectral data copied according to the sub information decoded by the second decoding unit 425, that is, the scale factor value for deriving the peak value "1", is adjusted, and the adjusted spectral data is outputted as that in the higher frequency band. The amplitude is adjusted by multiplying each spectral data in the band by a ratio between the absolute maximum value of the spectral data copied in the band and the value obtained by dequantizing the quantized value "1" using the scale factor value corresponding to that band, as a coefficient, for every scale factor band. Here, the maximum number of samples of the spectral data outputted by the second dequantizing unit 435 is 1,024, and they represent the reproduction bandwidth over 11.025 kHz.

Figure 14:
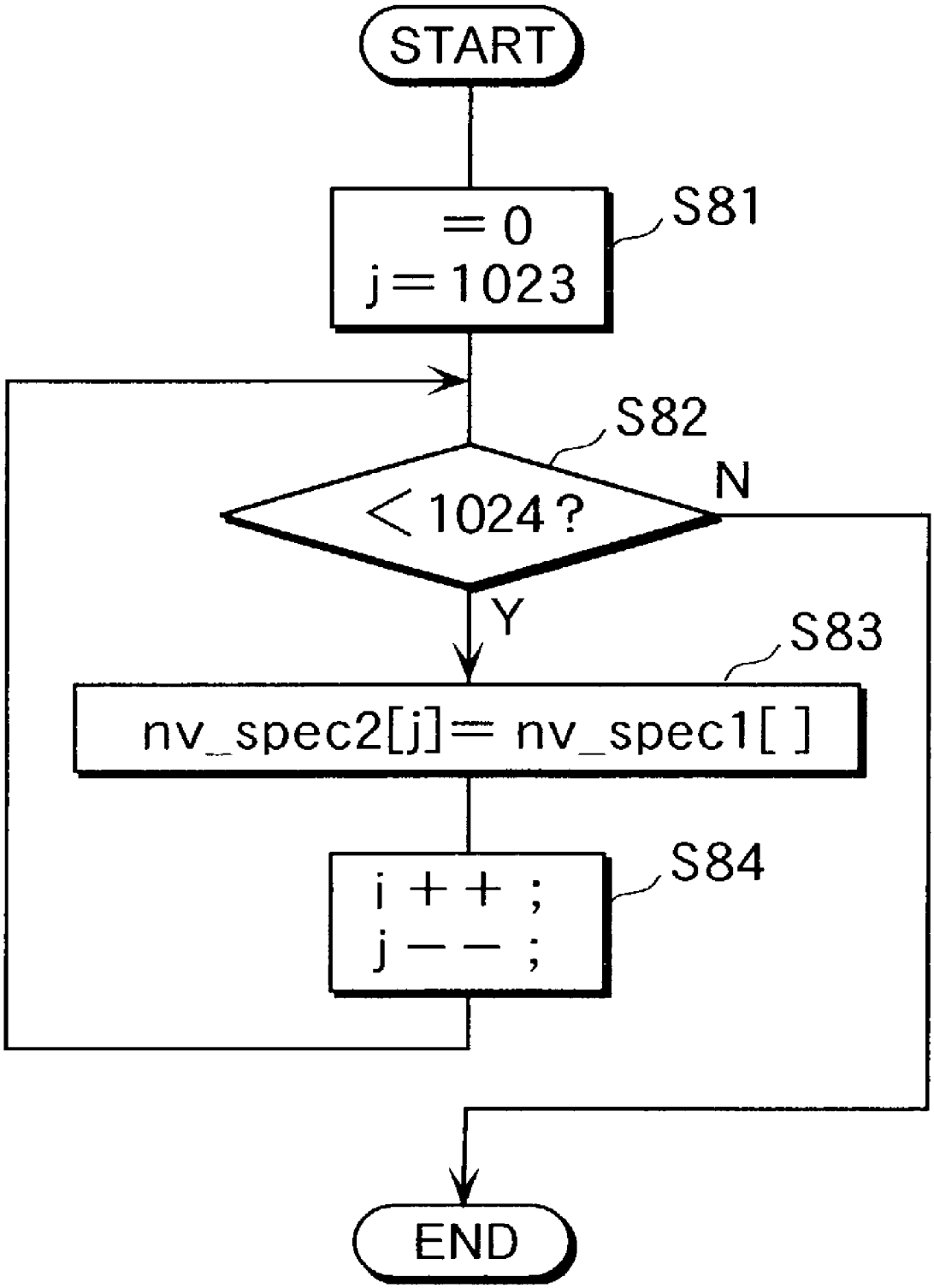
FIG. 14 is a flowchart showing the procedure by which the second dequantizing unit shown in FIG. 2 copies 1,024 spectral data in the lower frequency band to the higher frequency band in the reverse direction of the frequency axis.

The procedure for copying the 1,024 spectral data in the lower frequency band into the higher frequency band in the forward order in the frequency axis direction in FIG. 13, but they may be copied in the reverse direction, as shown in FIG. 14.

FIG. 14 is a flowchart showing a procedure by which the second dequantizing unit 435 shown in FIG. 2 copies a spectrum in the lower frequency band 1,024 to the higher frequency band in reverse direction on the frequency axis. In FIG. 14, as in the case of FIG. 13, inv_spec1[i] indicates a value of the ith spectral data among the output data from the first dequantizing unit 430, and inv_spec2[j] indicates a value of the jth spectral data among the input data of the second dequantizing unit 435.

First, the second dequantizing unit 435 sets the initial value of a counter i to be "0" and the value of a counter j to be "1,023", which count the number of spectral data, in order to input spectra of 0th through 1,023rd in the reverse direction (S81). Next, the second dequantizing unit 435 checks whether the value of the counter i is less than "1,024" or not (S82). When the value of the counter i is less than "1,024", the second dequantizing unit 435 inputs the value of the ith (0th in this case) spectral data in the lower frequency band of the first dequantizing nit 430 as the value of the jth (1,023rd in this case) spectral data in the higher frequency band of the second dequantizing unit 435 (S83). Then, the second dequantizing unit 435 increments the value of the counter i by "1" and decrements the value of the counter j by "1" (S84), an whether the value of the counter i is less than "1,024" or not (S82).

The second dequantizing unit 435 repeats the above processing while the value of the counter i is less than "1,024", and ends the processing when the value becomes "1,024" or more.

As a result, all the 0th~1,023rd spectral data in the lower frequency band that are the results of dequantization by the first dequantizing unit 430 are copied in the reverse direction as the 1,023rd~0th spectral data in the higher frequency band of the second dequantizing unit 435.

Same as above, the amplitude of the spectral data copied according to the sub information decoded by the second decoding unit 425, that is, the scale factor value for deriving the peak value "1", is adjusted, and the adjusted spectral data is outputted as that in the higher frequency band. The amplitude is adjusted by multiplying each spectral data in the band by a ratio between the absolute maximum value of the spectral data copied in the band and the value obtained by dequantizing the quantized value "1" using the scale factor value corresponding to that band, as a coefficient, for every scale factor band. Here, the maximum number of samples of the spectral data outputted by the second dequantizing unit 435 is 1,024, and they represent the reproduction bandwidth over 11.025 kHz.

In the present embodiment, the second dequantizing unit 435 copies all the spectral data in the lower frequency band to the higher frequency band, but it may copy only a part of them.

Examples of procedures of copying the higher frequency band and the lower frequency band all at once are described with reference to FIG. 13 and FIG. 14. However, a part of them may be copied according to the procedure shown in FIG. 13 and another part of them may be copied according to the procedure shown in FIG. 14.

Also, a part or all of them may be copied by inverting the positive and negative signs thereof.

These copying procedures may be predetermined, or may be changed depending upon the data in the lower frequency band, or may be transmitted as the sub information.

In the present embodiment, the spectral data in the lower frequency band is copied as that in the higher frequency band, but the present invention is not limited to that, and the spectral data in the higher frequency band may be generated only from the second encoded information.

In the present embodiment, as for the noise generation in the second dequantizing unit 435, the case where the spectral data obtained mainly from the first dequantizing unit 430 is copied is described. However, the present invention is not limited to that, spectral data, white noise, pink noise and so on having a certain value in each scale factor band in the higher frequency band may be generated in the second dequantizing unit 435 in its own way, or may be generated according to the sub information.

The 1,024 samples of spectral data outputted from the second dequantizing unit 435 are integrated with the 1,024 spectral data outputted from the first dequantizing unit 430 in the dequantized data integrating unit 440, IMDCT transformed into the audio data in the time domain, D/A converted at a sampling frequency of 44.1 kHz, and then the audio signal is reproduced with the reproduction bandwidth of 0~22.05 kHz.

As described above, according to the present invention, the first 1,024 samples among the spectral data of 2,048 samples are encoded as usual using MDCT and IMDCT with a transformation length twice as long as the conventional one, and the latter half 1,024 samples are encoded with less amount of information than the conventional one, and both spectral data are integrated for decoding.

Since the amount of information required for encoding the latter half spectral data of 1,024 samples can be reduced, the amount of information required for encoding the first half spectral data of 1,024 samples can be increased, and therefore, the spectral data over a wide bandwidth can be encoded while the accuracy of reproduction of original signals in the lower frequency band is improved.

Also, the bit stream generated by the encoding device of the present embodiment can be decoded by the conventional decoding device.

Next, variations of the sub information and decoding thereof will be explained.

Figure 15:
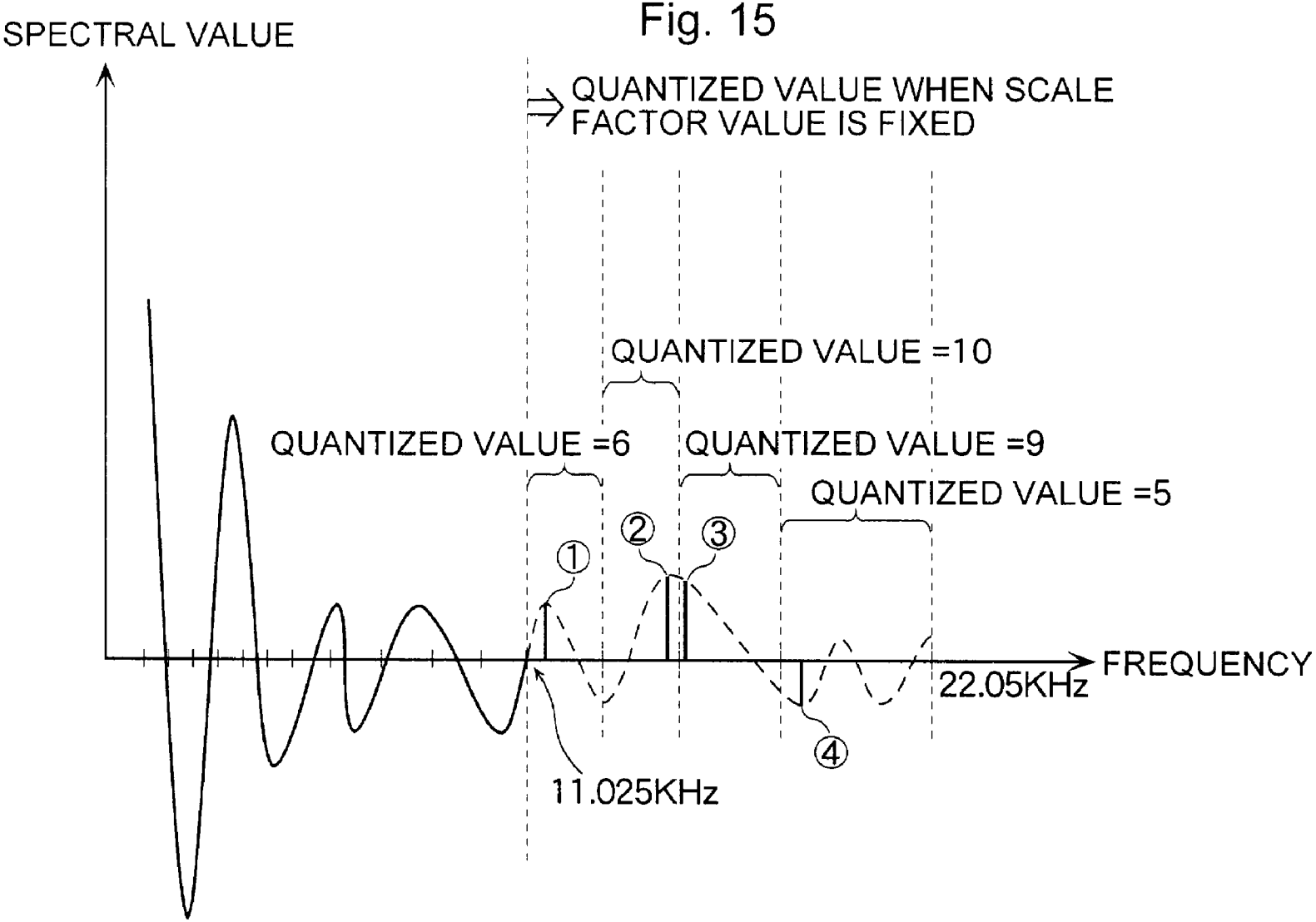
FIG. 15 shows a spectral waveform showing a concrete example of the other sub information (quantized value) which is generated by the second quantizing unit shown in FIG. 2.
Figure 16:
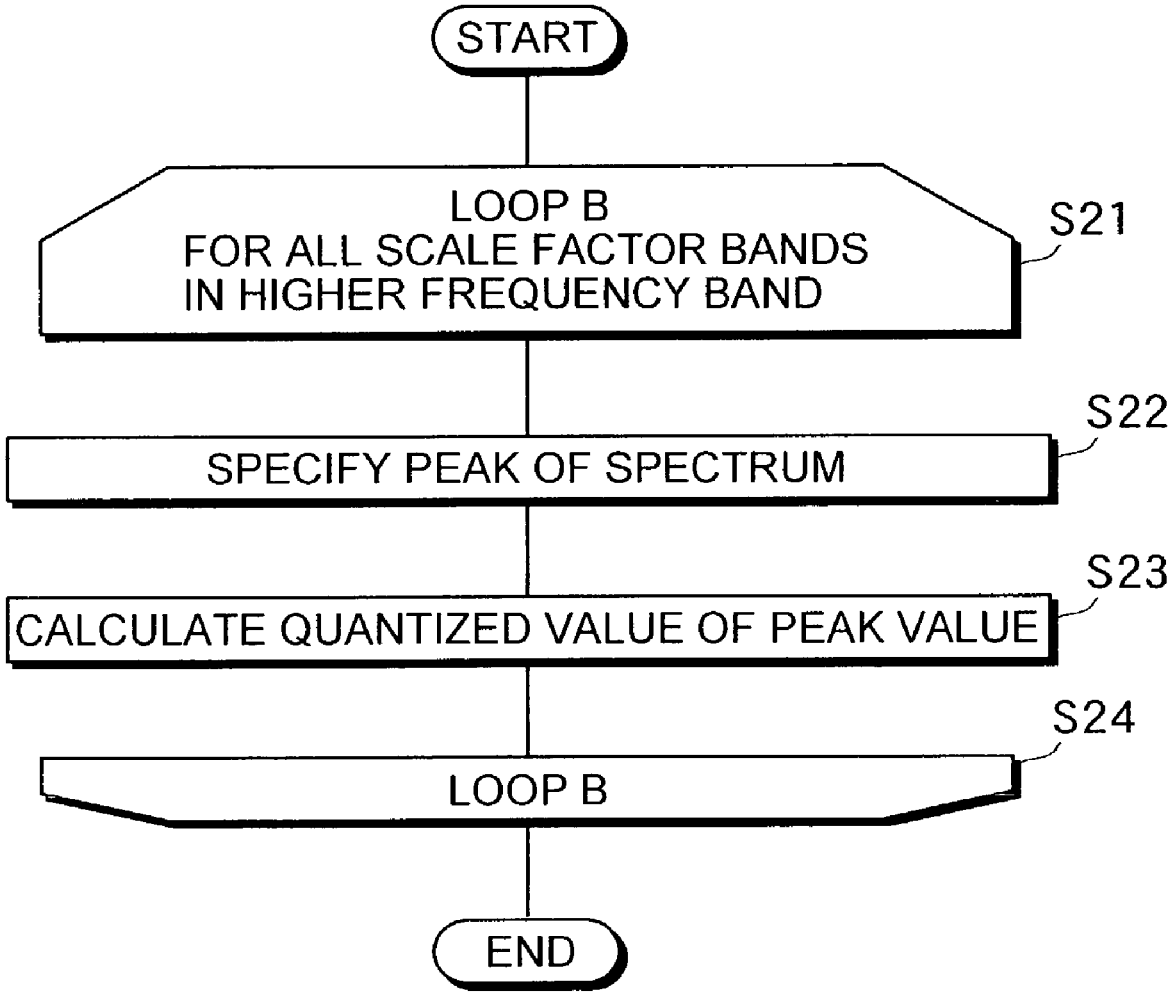
FIG. 16 is a flowchart showing an operation in the other sub information (quantized value) calculation processing performed by the second quantizing unit shown in FIG. 2.

FIG. 15 shows a spectral waveform showing a concrete example of the other sub information (quantized value) which is generated by the second quantizing unit 345 shown in FIG. 2. FIG. 16 is a flowchart showing an operation in the other sub information (quantized value) calculation processing performed by the second quantizing unit 345 shown in FIG. 2.

The second quantizing unit 345 predetermines a scale factor value, "18", for instance, common to all the scale factor bands in the higher frequency band having the reproduction bandwidth over 11.025 kHz up to 22.05 kHz, and using this scale factor value "18", calculates the quantized value of the absolute maximum spectral data (peak) in each scale factor band (S21).

The second quantizing unit 345 specifies the absolute maximum spectral data (peak) in the first scale factor band in the higher frequency band having the reproduction bandwidth over 11.025 kHz (S22). In the example of FIG. 15, ① indicates the peak specified in the first scale factor band and the peak value at that time is "256".

The second quantizing unit 345 calculates the quantized value by applying the predetermined common scale factor value "18" and the peak value "256" to a formula for calculating the quantized value (S23). For example, if the peak value "256" is quantized with the scale factor value "18", the quantized value "6" is calculated.

When the quantized value "6" of the peak value "256" is calculated for the first scale factor band (S24), the second quantizing unit 345 specifies the peak of the spectral data in the next scale factor band (S22). If the specified peak position is ② and the peak value is "312", for instance, it calculates the quantized value "10", for instance, of the peak value "312" with the scale factor value "18" (S23).

In the same manner, the second quantizing unit 345 calculates the quantized value "9" of the peak ③ value "288" with the scale factor value "18" for the third scale factor band in the higher frequency band, and calculates the quantized value "5" of the peak ④ value "203" with the scale factor value "18" for the fourth scale factor band.

When the quantized values of the peak values with the fixed scale factor "18" for all the scale factor bands in the higher frequency band are calculated (S24), the second quantizing unit 345 outputs the quantized value of each scale factor band obtained by the calculation to the second encoding unit 355 as sub information for the higher frequency band, and ends the processing.

As described above, the second quantizing unit 345 generates the sub information (quantized value). This sub information represents the 4 scale factor bands in the higher frequency band represented in 1,024 samples of spectral data, in quantized values of 4 bits, respectively, while the above-mentioned sub information (scale factor) represents the 4 scale factor bands in the higher frequency band, in spectral data of 8 bits, respectively. Therefore, the data amount in the higher frequency band is much more reduced in the case of the quantized value. Also, this quantized value roughly represents the amplitude of the peak value (absolute value) of each scale factor band, and it can be said that the 1,024 samples of spectral data of in the higher frequency band taking a fixed value or the spectral data obtained by just multiplying a copy of a part or all of the spectral data in the lower frequency band by the quantized value roughly reconstructs the spectral data obtained based on the input audio signals. Also, the spectral data can be reconstructed more accurately by multiplying each spectral data in the band by a ratio between the absolute maximum value of the spectral data copied in the band and the value obtained by dequantizing the quantized value corresponding to that band, as a coefficient, for every scale factor band.

In the present embodiment, the scale factor value corresponding to the quantized value to be transmitted as the second encoded information is predetermined, but the optimum scale factor value may be calculated and transmitted with being added to the second encoded information. For example, if a scale factor for deriving the maximum value "7" of the quantized value is selected, the number of bits indicating the quantized value is only 3, so the information amount required for transmitting the quantized value is much more reduced.

Figure 17:
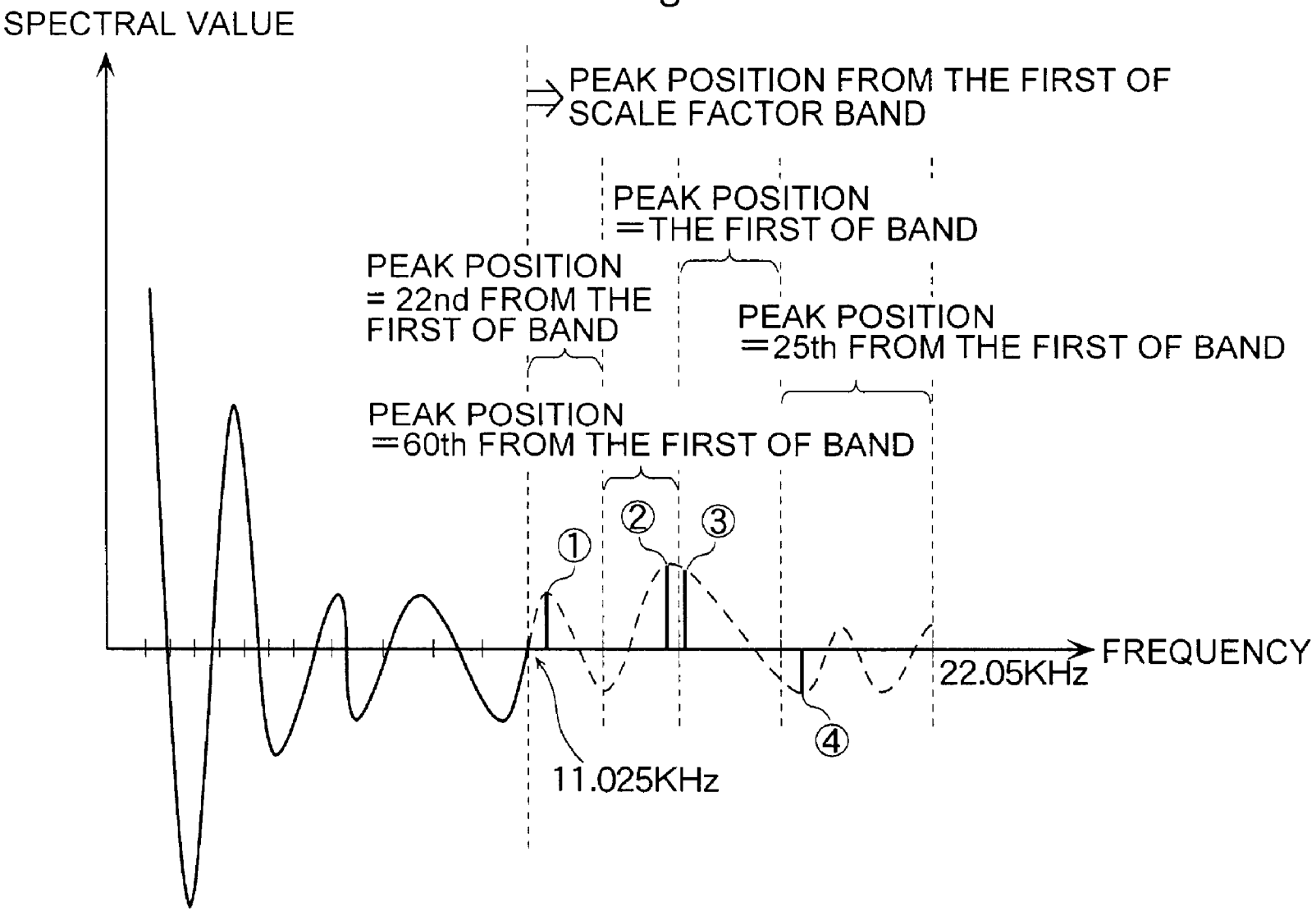
FIG. 17 shows a spectral waveform showing a concrete example of the other sub information (position information) which is generated by the second quantizing unit shown in FIG. 2.
Figure 18:
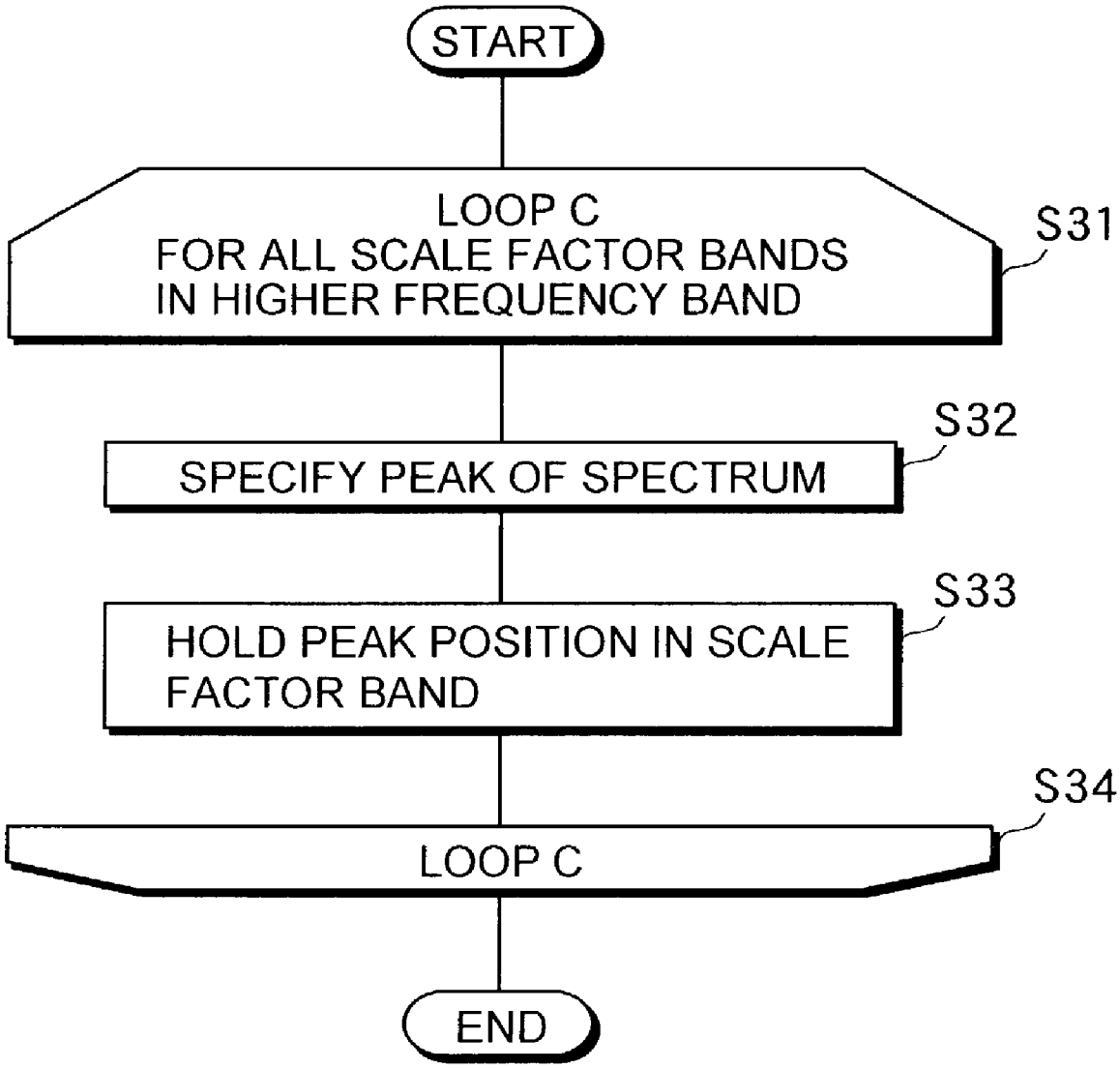
FIG. 18 is a flowchart showing an operation in the other sub information (position information) calculation processing performed by the second quantizing unit shown in FIG. 2.

FIG. 17 shows a spectral waveform showing a concrete example of the other sub information (position information) which is generated by the second quantizing unit 345 shown in FIG. 2. FIG. 18 is a flowchart showing an operation in the other sub information (position information) calculation processing performed by the second quantizing unit 345 shown in FIG. 2.

The second quantizing unit 345 specifies the position of the absolute maximum spectral data in every scale factor band in the higher frequency band having the reproduction bandwidth over 11.025 kHz up to 22.05 kHz according to the following procedure (S31).

The second quantizing unit 345 specifies the absolute maximum spectra data (peak) in the first scale factor band in the higher frequency band having the reproduction bandwidth over 11.025 kHz (S32). In the example of FIG. 17, ① indicates the peak specified in the first scale factor band and the 22nd spectral data from the first one of this scale factor band. The second quantizing unit 345 holds the specified peak position "the 22nd spectral data from the first one of the scale factor band" (S33).

When the peak position is specified and held for the first scale factor band (S34), the second quantizing unit 345 specifies the peak of the spectral data in the next scale factor band (S32). For example, the specified peak is positioned at ② and the 60th spectral data from the first one of the scale factor band. The second quantizing unit 345 holds the specified peak position "the 60th spectral data from the first one of the scale factor band" (S33).

In the same manner, the second quantizing unit 345 specifies and holds the peak ③ position in the third scale factor band in the higher frequency band "the first spectral data of the scale factor band", and specifies and holds the peak ④ position in the fourth scale factor band "the 25th spectral data from the first one of the scale factor band".

When the peak positions for all the scale factor bands in the higher frequency bands are specified and held (S34), the second quantizing unit 345 outputs the held peak positions of the scale factor bands to the second encoding unit 355 as the sub information for the higher frequency band, and ends the processing.

As described above, the second quantizing unit 345 generates the sub information (position information). This sub information (position information) represents the 4 scale factor bands in the higher frequency band represented in 1,024 samples of spectral data, in position information of 6 bits, respectively.

In this case, the second dequantizing unit 435 in the decoding device 400 copies a part or all of the 1,024 samples of spectral data in the lower frequency band as the 1,024 samples of sample data in the higher frequency band in accordance with the sub information (position information) inputted from the second decoding unit 425. The spectral data in the lower frequency band is copied by extracting the similar data from the spectral data outputted from the first dequantizing unit 430 based on the peak information of the spectral data in one or more scale factor band and copying a part or all of it. Also, the second dequantizing unit 435 adjusts the amplitude of the copied spectral data if necessary. The amplitude is adjusted by multiplying each spectral data by a predetermined coefficient, "0.5", for instance. This coefficient may be a fixed value, or may be changed for every bandwidth or scale factor band, or changed depending upon the spectral data outputted from the first dequantizing unit 430.

In the present embodiment, a predetermined coefficient is used, but this coefficient value may be added to the second encoded information as sub information. Or the scale factor value may be added to the second encoded information as a coefficient, or the quantized value of the peak in the scale factor band may be added to the second encoded information as a coefficient. The amplitude adjusting method is not limited to that mentioned above, and another method can be used.

In the present embodiment, only the position information or only the position information and the coefficient information are encoded, but the present invention is not limited to that. A scale factor, a quantized value, sign information of a spectrum, a noise generation method, and others may be encoded. Or a combination of two or more of them may be encoded.

In addition, in the present embodiment, the spectral data in the lower frequency band is copied as the spectral data of the higher frequency data. However, the present invention is not limited to that, and the spectral data in the higher frequency band may be generated from the second encoded information only.

Figure 19:
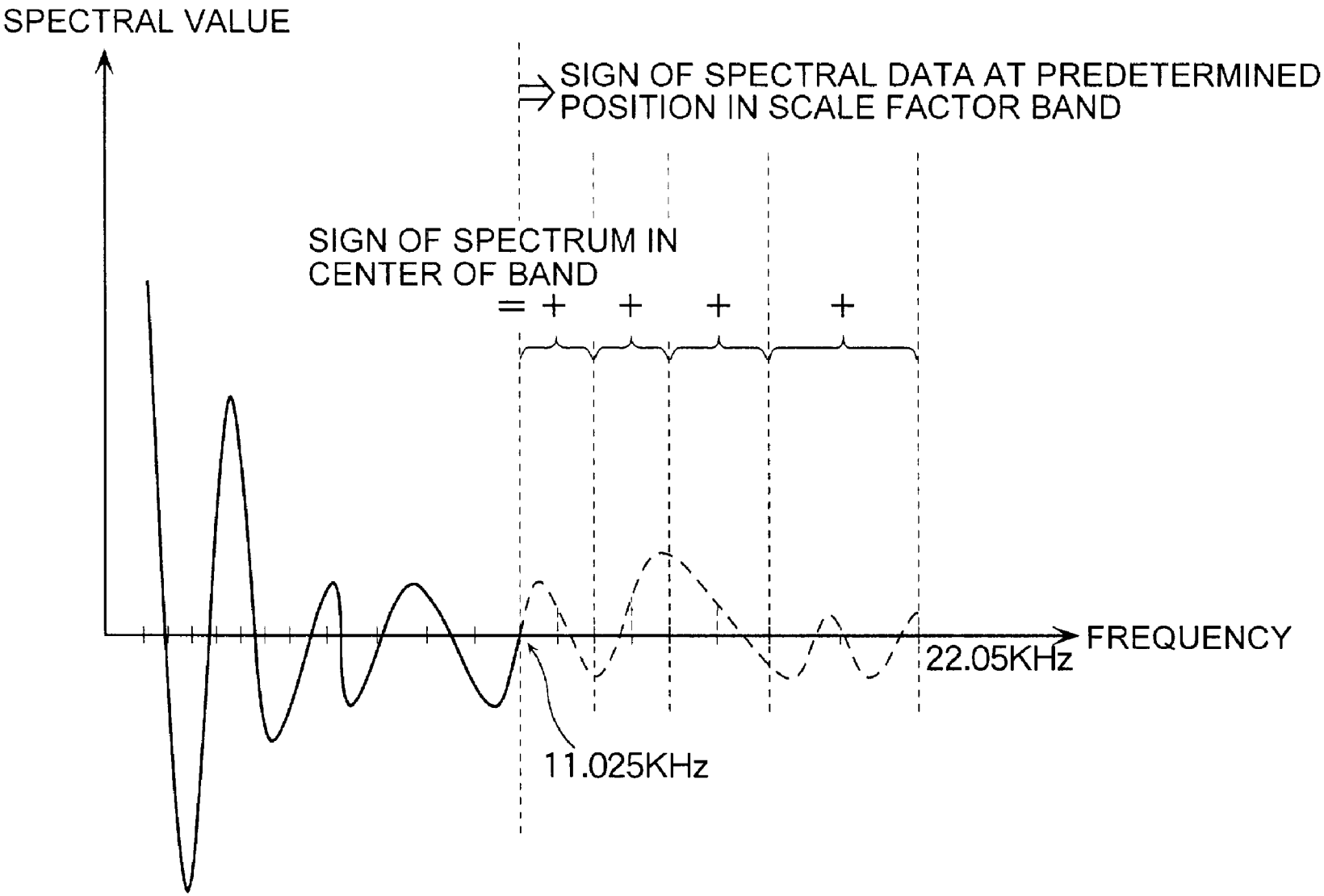
FIG. 19 shows a spectral waveform showing a concrete example of the other sub information (sign information) which is generated by the second quantizing unit shown in FIG. 2.
Figure 20:
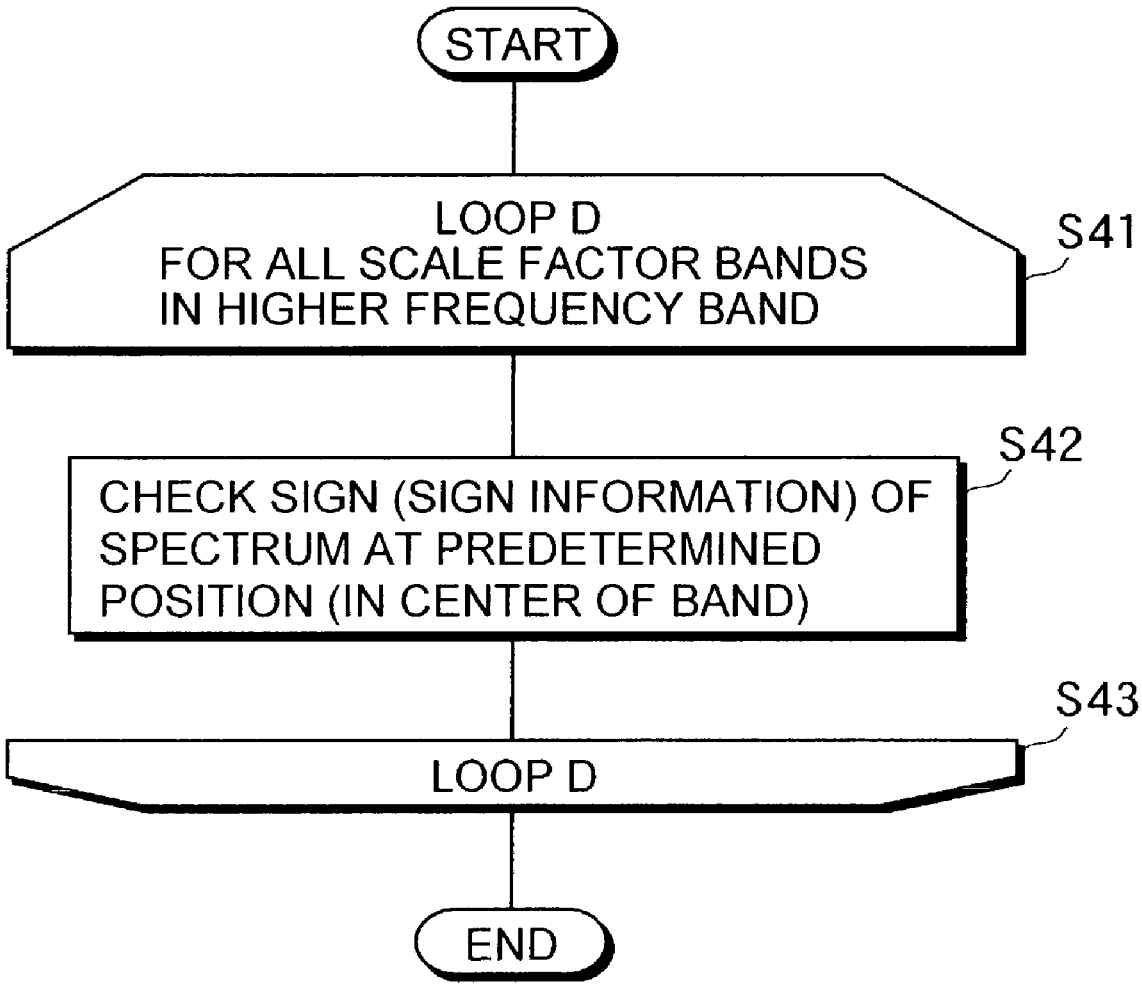
FIG. 20 is a flowchart showing an operation in the other sub information (sign information) calculation processing performed by the second quantizing unit shown in FIG. 2.

FIG. 19 shows a spectral waveform showing a concrete example of the other sub information (sign information) which is generated by the second quantizing unit 345 shown in FIG. 2. FIG. 20 is a flowchart showing an operation in the other sub information (sign information) calculation processing performed by the second quantizing unit 345 shown in FIG. 2.

The second quantizing unit 345 specifies the sign information of the spectral data at a predetermined position, in the center, for instance, of every scale factor band in the higher frequency band having the reproduction bandwidth over 11.025 kHz up to 22.05 kHz according to the following procedure (S41).

The second quantizing unit 345 checks the sign information of the spectral data in the center position of the first scale factor band in the higher frequency band having the reproduction bandwidth over 11.025 kHz (S42), and holds the value. For example, the sign of the spectral data in the center position of the first scale factor band is "+". The second quantizing unit 345 represents this sign "+" in a value of 1 bit "1", and holds it. When the sign is "−" the second quantizing unit 345 represents it in "0" and holds it.

When the sign information of the spectral data in the center position of the first scale factor band is held (S43), the second quantizing unit 345 checks the sign of the spectral data in the center position of the next scale factor band (S42). For example, the sign is "+", the second quantizing unit 345 holds "1" as the sign information of the spectral data in the center position of the second scale factor band.

In the same manner, the second quantizing unit 345 checks the sign "+" of the spectral data in the center position of the third scale factor band in the higher frequency band, and holds the sign information "1". The second quantizing unit 345 further checks the sign "+" of the spectral data in the center position of the fourth scale factor band, and holds the sign information "1".

When the sign information of the spectral data in the center positions of all the scale factor bands in the higher frequency band are held (S43), the second quantizing unit 345 outputs the held sign information of the scale factor bands to the second encoding unit 355 as the sub information for the higher frequency band, and ends the processing.

As described above, the second quantizing unit 345 generates the sub information (sign information). This sub information (sign information) represents the 4 scale factor bands in the higher frequency band represented in 1,024 samples of spectral data, in sign information of 1 bit, respectively, and therefore, the spectrum in the higher frequency band can be represented with a very short data length.

In this case, the second dequantizing unit 435 in the decoding device 400 copies a part or all of the spectral data of 1,024 samples in the lower frequency band as the spectrum in the higher frequency band, and determines the sign of the spectral data in a predetermined position in accordance with the sign information inputted from the second decoding unit 425.

The sign information indicating the sign in the center position of each scale factor band in the higher frequency band is used as sub information (sign information). However, the present invention is not limited to the center position of the scale factor band., and each peak position, the first spectral data of each scale factor band, or other predetermined positions may be used.

In the present embodiment, the position of the spectral data corresponding to the sign (sign information) to be transmitted is predetermined, but it may be changed depending upon the output of the first dequantizing unit 430, or the position information indicating the position of the sign information of each scale factor band may be added to the second encoded information and transmitted.

Also, the second dequantizing unit 435 adjusts the amplitude of the copied spectral data if necessary. The amplitude is adjusted by multiplying each spectral data by a predetermined coefficient, "0.5", for instance.

This coefficient may be a fixed value, or may be changed for every bandwidth or scale factor band, or changed depending upon the spectral data outputted from the first dequantizing unit 430. The amplitude adjusting method is not limited to this, and any other methods may be used.

In the present embodiment, a predetermined coefficient is used, but this coefficient value may be added to the second encoded information as sub information. Or the scale factor value may be added to the second encoded information as a coefficient, or a quantized value may be added to the second encoded information as a coefficient.

In the present embodiment, only the sign information, only the sign information and the coefficient information, or only the sign information and the position information are encoded, but the present invention is not limited to that. A quantized value, a scale factor, position information of a characteristic spectrum, a noise generation method, and others may be encoded. Or a combination of two or more of them may be encoded.

In addition, in the present embodiment, the spectral data in the lower frequency band is copied as the spectral data of the higher frequency data. However, the present invention is not limited to that, and the spectral data in the higher frequency band may be generated from the second encoded information only.

In the present embodiment, the sign "+" is represented in a value of 1 bit "1", and the sign "−" is represented in "0". However, the present invention is not limited to this representation of the sign in the sub information (sign information), and any other value may be used.

Figure 21A:
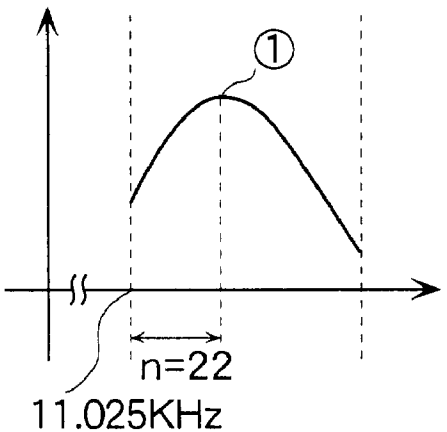
FIGS. 21A and 21B show spectral waveforms showing an example of how to create the other sub information (copy information) which is generated by the second quantizing unit shown in FIG. 2.
Figure 21B:
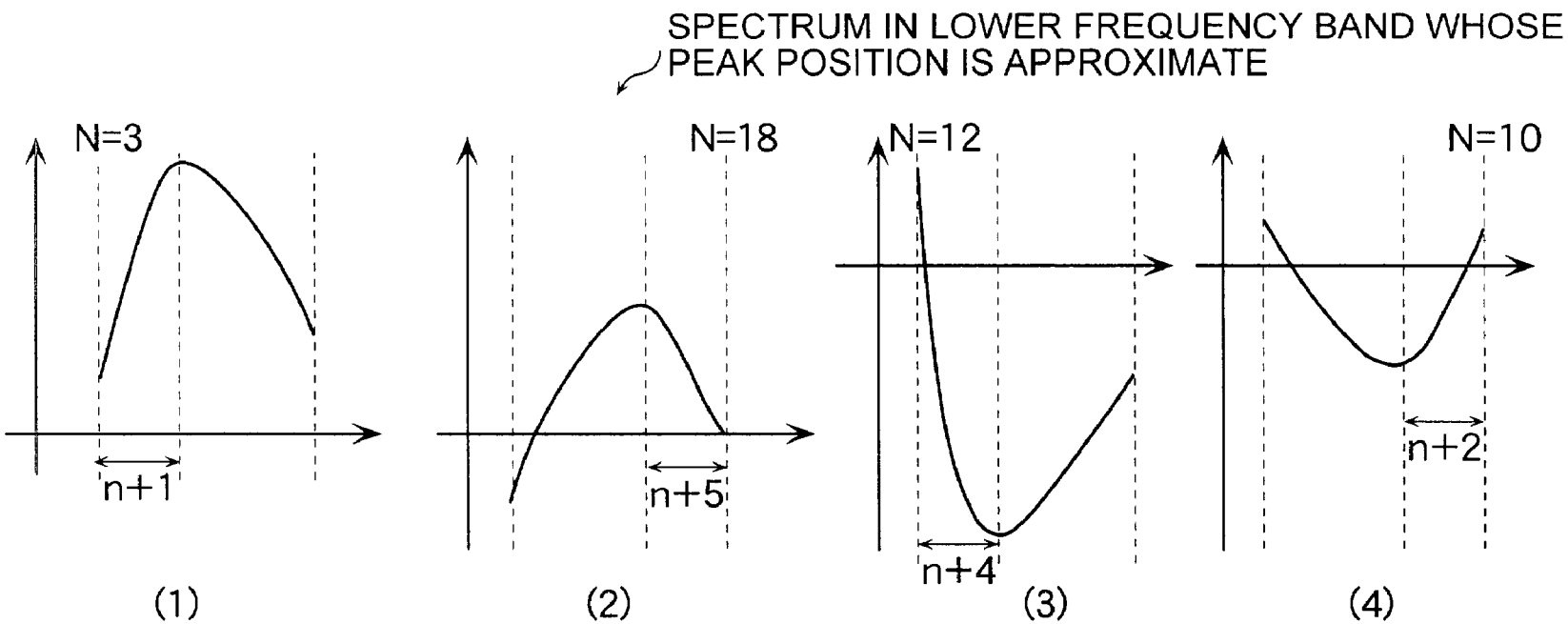
Figure 22:
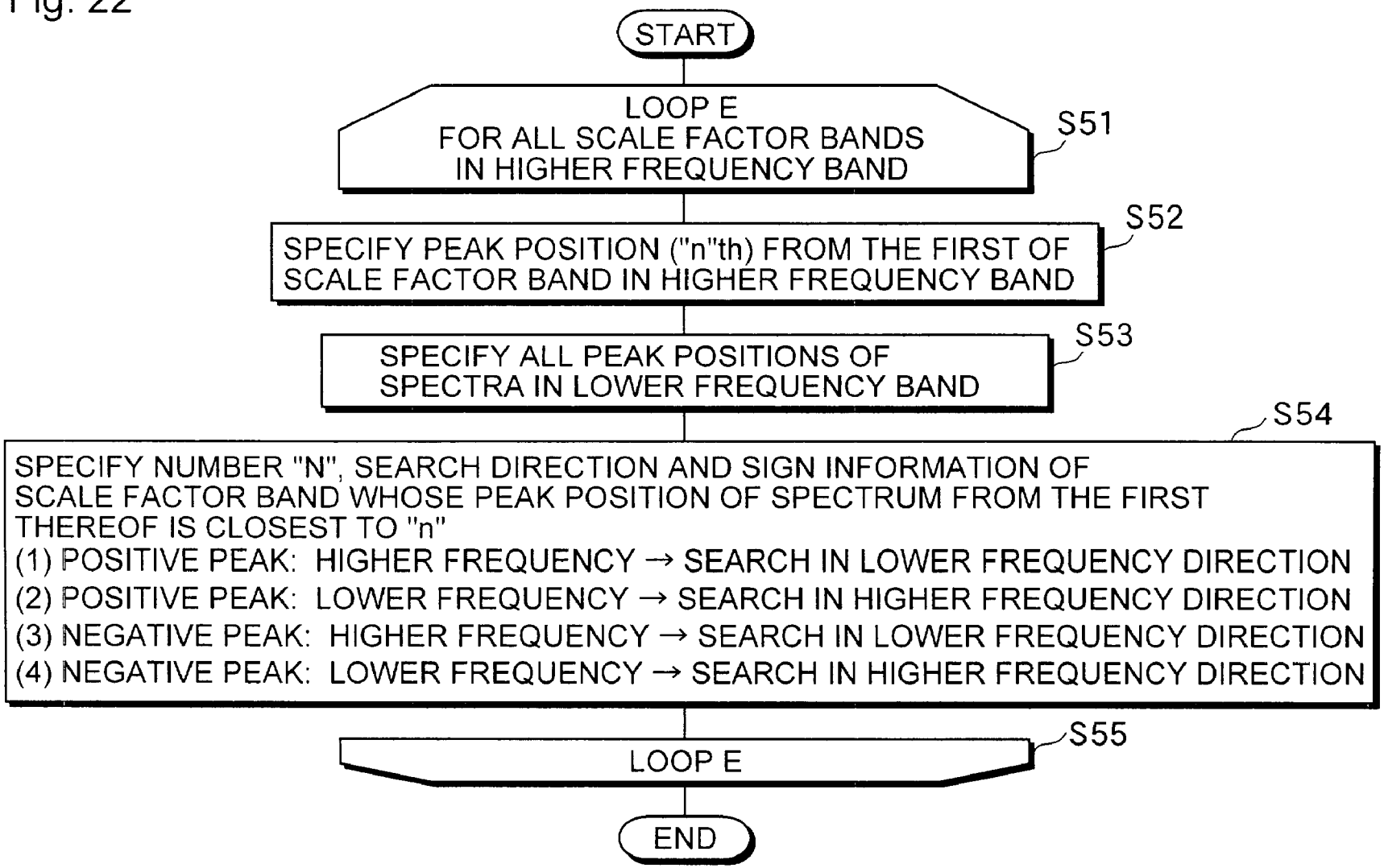
FIG. 22 is a flowchart showing an operation in the other sub information (copy information) calculation processing performed by the second quantizing unit shown in FIG. 2.

FIGS. 21A and 21B show spectral waveforms showing examples of how to create the other sub information (copy information) which is generated by the second quantizing unit 345 shown in FIG. 2. FIG. 21A shows a spectral waveform in the first scale factor band in the higher frequency band. FIG. 21B shows examples of spectral waveforms in the lower frequency band specified with sub information (copy information). FIG. 22 is a flowchart showing an operation in the other sub information (copy information) calculation processing performed by the second quantizing unit 345 shown in FIG. 2.

For every scale factor band in the higher frequency band having the reproduction bandwidth over 11.025 kHz up to 22.05 kHz, the second quantizing unit 345 specifies the number N of the scale factor band in the lower frequency band according to the following procedure (S51). The scale factor band No. N in the lower frequency band is specified because the value of the peak position of that band is closest to the peak position "n" of the scale factor band ("n"th data from the first one of the scale factor band) in the higher frequency band.

The second quantizing unit 345 specifies the absolute maximum spectra data (peak) position "n" in the first scale factor band in the higher frequency band having the reproduction bandwidth over 11.025 kHz (S52). As shown in FIG. 21A, ① indicates the specified peak "n" and the spectral data value at that position is n=22.

The second quantizing unit 345 specifies the peak positions of all the spectra (including both positive and negative spectra) in the lower frequency band having the reproduction bandwidth of 11.025 kHz or less (S53).

Next, for every specified peak in the lower frequency band, the second quantizing unit 345 searches for the scale factor band whose peak position from the first thereof is closest to "n", and specifies the number N of that scale factor band, the search direction and the sign information of the peak (S54).

Specifically, for every specified peak (including both positive and negative) in the lower frequency band, the second quantizing unit 345 searches for the first of the scale factor band whose peak position is closest to "n" sequentially from the lower frequency side.

There are two search directions; (1) search from the peak in the lower frequency direction, and (2) search from the peak in the higher frequency direction. In addition, as for the peaks in the lower frequency band whose positive and negative signs are inverted from those in the higher frequency band, there are also two search directions; (3) search from the peak in the lower frequency direction, and (4) search from the peak in the higher frequency direction.

In the case of the search directions (2) and (4), when the spectral waveform in the lower frequency band is copied based on the peak information, the peak position in the higher frequency band and the peak position in the lower frequency band are inverted from side to side (in the frequency axis direction), as shown in FIG. 21B. Therefore, it is necessary to attach information indicating the search direction (forward and reverse) when (1) and (3) are the forward search direction and (2) and (4) are the reverse search direction, for instance. Also, in the case of the search directions (3) and (4), the peak position in the higher frequency band and the peak position in the lower frequency band are inverted up and down (in the vertical axis direction), as shown in FIG. 21B. Therefore, it is necessary to attach information indicating whether the positive and negative signs of the peak values of the higher and lower frequency bands are inverted or not.

The second quantizing unit 345 makes searches in the four directions, that is, in the search directions (1) and (2) if the peak value specified in the lower frequency band is positive, and in the search directions (3) and (4) if the peak value is negative, and then specifies the number of the scale factor band whose peak position is closest to "n" among the search results. In this case, a certain value, "5", for instance, is predetermined as a tolerance between "n" and the actual peak position, the second quantizing unit 345 selects the scale factor band whose peak position is closest to "n" among the four kinds of search results, and specifies the number N of that scale factor band. In addition, it specifies the sign information indicating whether the signs of the peak values in the higher frequency band and the lower frequency band are inverted or not and the information indicating the search direction (forward or reverse).

For example, in the search direction (1), the number N=3 of the scale factor band is specified with tolerance from the peak position of "1" for the spectrum in the lower frequency band as shown in FIG. 21B (1). Similarly, in the search directions (2), (3) and (4), the numbers N=18, N=12 and N=10 of the scale factor bands are specified with tolerances from the peak positions of "5", "4" and "2" for the spectra in the lower frequency bands as shown in FIG. 21B (2), (3) and (4), respectively. The second quantizing unit 345 selects the number N=3 of the scale factor band whose peak position is closest to "n" with tolerance from the peak position of "1", among these specified four numbers of the scale factor bands. In addition, it generates the sign information "1" indicating the sign "+" of the peak in the lower frequency band and the search direction information "1" indicating the search in the lower frequency direction. In this case, if the sign of the peak is "−", the sign information is "0", and if the search is made in the higher frequency direction, the search direction information is "0".

When the scale factor band number N=3, the sign information "1" and the search direction information "1" are specified for the first scale factor band in the higher frequency band (S55), the second quantizing unit 345 specifies the number N, the sign information and the search direction information of the next scale factor band in the same manner as above.

In this manner, the number N, the sign information and the search direction information of every scale factor band in the lower frequency band whose peak position from the first thereof is closest to the peak position "n" from the first of the scale factor band in the higher frequency band (S55). Then, the second quantizing unit 345 outputs the specified number N, the sign information and the search direction information of the scale factor band in the lower frequency band corresponding to each scale factor band in the higher frequency band to the second encoding unit 355 as the sub information (copy information) for the higher frequency band, and ends the processing.

In this case, if the first encoded signal is decoded according to the conventional procedure in the decoding device 400, the spectral data of 1,024 samples of the lower frequency side can be obtained. The second dequantizing unit 435 copies a part or all of the spectral data corresponding to the scale factor band numbers outputted from the second decoding unit 425 as the spectra in the higher frequency band. The second dequantizing unit 435 adjusts the amplitude of the copied spectral data if necessary. The amplitude is adjusted by multiplying each spectrum by a predetermined coefficient, 0.5, for instance.

This coefficient may be a fixed value, or may be changed for every scale factor band or depending upon the spectral data outputted from the first dequantizing unit 430.

In the present embodiment, a predetermined coefficient is used, but this coefficient value may be added to the second encoded information as sub information. Or the scale factor value may be added to the second encoded information as a coefficient, or the quantized value may be added to the second encoded information as a coefficient. Also, the amplitude adjusting method is not limited to the above, and any other methods may be used.

In the present embodiment, the sign information and the search direction information as well as the number N of the scale factor band are extracted as the sub information (copy information) for the higher frequency band. However, the sign information and the search direction information may be omitted depending upon the transmittable information amount for the higher frequency band. Also, the sign information is represented as "1" when the sign of the peak in the lower frequency band is "+", and it is represented as "0" when the sign is "−". The search direction information is represented as "1" when the search is made from the peak in the lower frequency direction, and it is represented as "0" when the search is made from the peak in the higher frequency direction. However, the sign of the peak in the lower frequency band in the sign information and the search direction in the search direction information are not limited to those, and they may be represented in other values.

Also, in the present embodiment, the first of the scale factor band in the lower frequency band whose specified peak position from the first is closest to "n" is searched. However, the present invention is not limited to that, and the peak whose position from the first of each scale factor band in the lower frequency band is closest to "n" may be searched.

Figure 23:
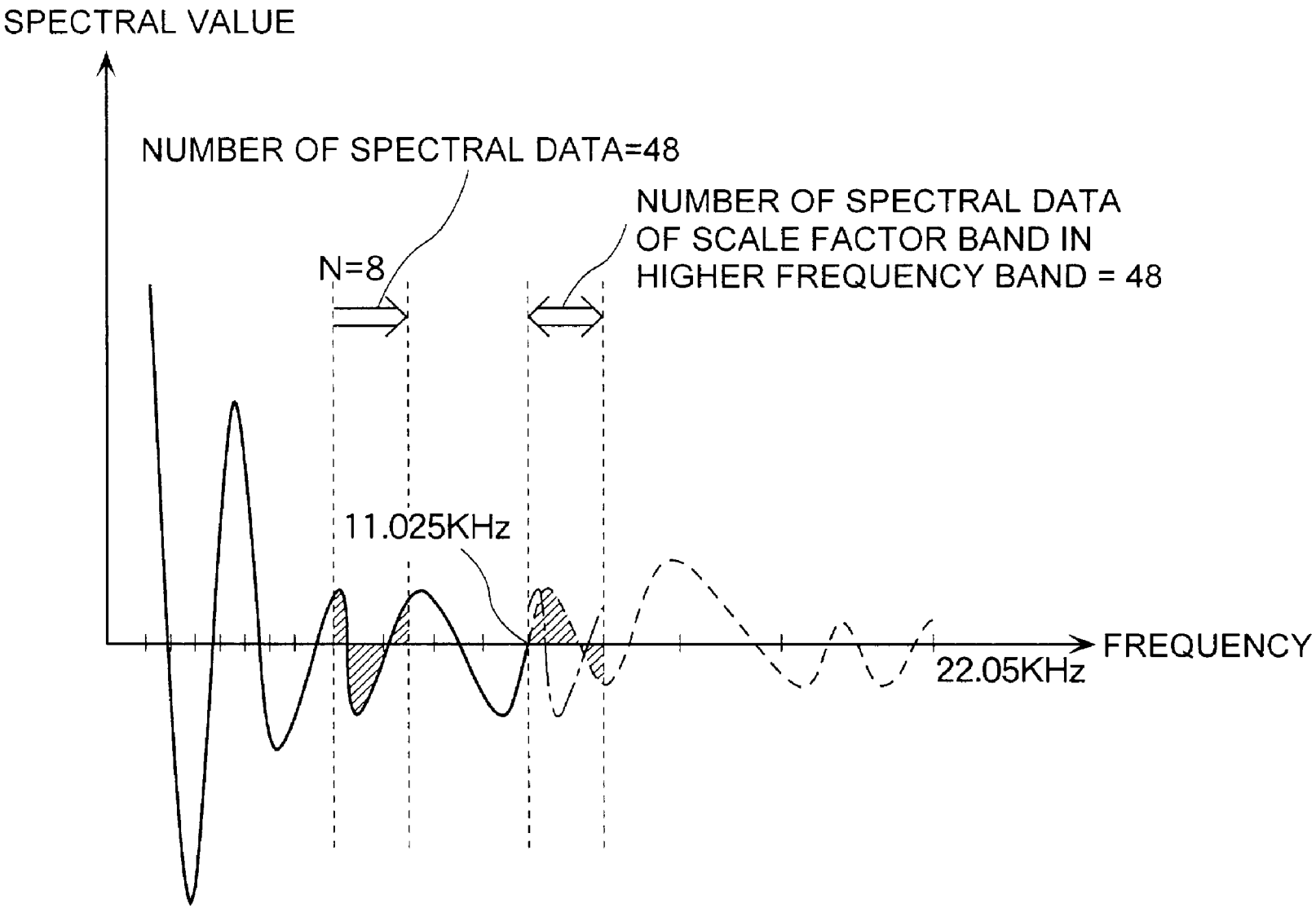
FIG. 23 shows a spectral waveform showing the second example of how to create the other sub information (copy information) which is generated by the second quantizing unit shown in FIG. 2.
Figure 24:
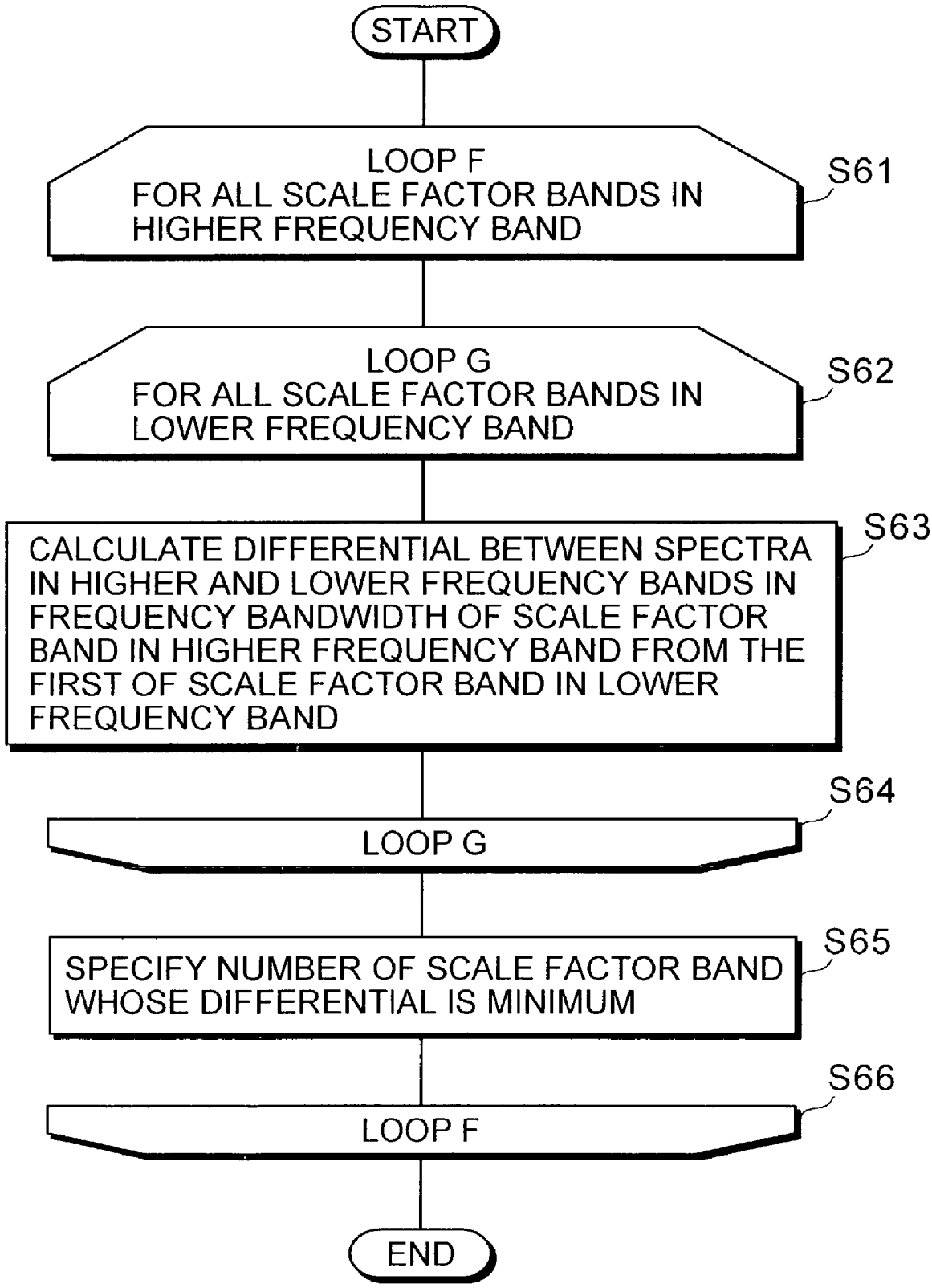
FIG. 24 is a flowchart showing an operation in the other sub information (copy information) calculation processing performed by the second quantizing unit shown in FIG. 2.

FIG. 23 shows a spectral waveform showing the second example of how to create the other sub information (copy information) which is generated by the second quantizing unit 345 shown in FIG. 2. FIG. 24 is a flowchart showing an operation in the second calculation processing of the other sub information (copy information) performed by the second quantizing unit 345 shown in FIG. 2.

For every scale factor band in the higher frequency band having the reproduction bandwidth over 11.025 kHz up to 22.05 kHz, the second quantizing unit 345 specifies the number N of the scale factor band in the lower frequency band whose differential (energy differential) from each spectrum in the scale factor band in the higher frequency band is minimum, according to the following procedure (S61). In this case, the number of spectral data in the lower frequency band is equal to the number of spectral data in the higher frequency band, and the number N of the specified scale factor band indicates the number of the first of that scale factor band.

For all the scale factor bands in the lower frequency band (S62), the second quantizing unit 345 calculates the differential between the spectra in the higher frequency band and those in the lower frequency band, in the frequency bandwidth comprising the same number of spectral data as that of the scale factor band in the higher frequency band, from the first data of the scale factor band in the lower frequency band (S63). For example, in the waveform as shown in FIG. 23, if the first scale factor band of the higher frequency band comprises 48 samples of spectral data, the second quantizing unit 345 calculates the differentials of the 48 spectral data between the higher frequency band and the lower frequency band, in sequence, from the first data of the scale factor band of number N=1 in the lower frequency band.

When the second quantizing unit 345 calculates the differential of the spectra between the higher frequency band and the lower frequency band (S65), it holds the value, and then calculates, for the next scale factor band, the differential of the spectra between the higher frequency band and the lower frequency band, in the frequency bandwidth comprising the same number of spectral data as that in the scale factor band in the higher frequency band from the first of the next scale factor band in the lower frequency band (S64). For example, when the differential of the spectra from the first of the scale factor band of number N=1 in the lower frequency band is calculated in the width of 48 samples of spectral data, the second quantizing unit 345 holds the value of the calculated differential, and further calculates the differential of the spectra from the first of the scale factor band of number N=2 in the lower frequency band in the width of 48 samples of spectral data. In the same way, the second quantizing unit 345 calculates the differential of the spectra by sequentially summing up the differentials of 48 spectral data between the higher frequency band and the lower frequency band, for all scale factor bands in the lower frequency bands from numbers N=3, 4, . . . 28 (the last scale factor band in the lower frequency band).

For all the scale factor bands in the lower frequency band, the second quantizing unit 345 calculates the differentials of the spectra between the higher frequency band and the lower frequency band, in the width of the same number of spectral data as that in the higher frequency band from the first of the scale factor band in the lower frequency band (S64). Then, the second quantizing unit 345 specifies the number N of the scale factor band in which the calculated differential is minimum (S65). For example, in the spectral waveform as shown in FIG. 23, the scale factor band of number N=8 in the lower frequency band is specified. In this figure, it is indicated that the differentials between the spectral data in the lower frequency band in shaded portions and the spectral data in the higher frequency band in shaded portions are minimum and the energy differential between the spectra is minimum. In other words, if 48 samples of spectral data from the first of the scale factor band of number N=8 are copied to the first scale factor band in the higher frequency band over 11.025 kHz, they become a waveform indicated by an alternate long and short dashed line in the higher frequency band in FIG. 23, and therefore, the energy in the corresponding scale factor band in the higher frequency band can be represented approximately to the original spectrum.

When the second quantizing unit 345 specifies the number N of the scale factor band in the lower frequency band whose differential from the spectrum of the scale factor band in the higher frequency band is minimum, it holds the specified number N of the scale factor band, and then specifies the number N of the scale factor band in the lower frequency band corresponding to the next scale factor band in the higher frequency band (S66). The second quantizing unit 345 repeats this processing in sequence, and when it specifies all the numbers N of the scale factor bands in the lower frequency band whose differentials from the spectra in the higher frequency band are minimum, it outputs the held numbers N of the scale factor band in the lower frequency band to the second encoding unit 355 as the sub information (copy information) for the higher frequency band, and ends the processing.

In the present embodiment, the method of copying the spectra in the lower frequency band in the decoding device 400 and adjusting the amplitude thereof are same as the case for the sub information (copy information) described with reference to FIG. 21 and FIG. 22.

In the flowchart of FIG. 24, the energy differentials of the same sign of spectral data between the higher frequency band and the lower frequency band are calculated in the same direction on the frequency axis. However, the encoding device of the present invention is not limited to that, and they may be calculated using any one of the following three methods, as described using FIG. 21 and FIG. 22: ① as for the spectral data in the higher frequency band which has the same sign and is sequentially selected in the direction from the lower frequency band to the higher frequency band, the same number of spectral data in the lower frequency band are sequentially selected from the first of the scale factor band in the lower frequency band in the direction from the higher frequency band to the lower frequency band (in the reverse direction on the frequency axis), and the differentials of the spectra are calculated, ② the signs of the spectra in the lower frequency band are inverted (multiplied by negative) and calculated in the same direction on the frequency axis, and ③ the signs of the spectra in the lower frequency band are inverted (multiplied by negative) and calculated in the reverse direction on the frequency axis. Or, after the calculations of the energy differentials are made according to all of the four methods, the number N of the scale factor band in the lower frequency band including the spectrum whose energy differential is minimum may be the sub information. In that case, in order to copy accurately the spectrum in the lower frequency band whose energy differential is minimum to the higher frequency band, the information indicating the relationship between the signs of the spectra of the higher and lower frequency bands and the information indicating the copying direction on the frequency axis are inserted into the sub information for every scale factor band. The information indicating the relationship between the signs of the spectra of the higher and lower frequency bands is represented by 1 bit, "1", for the differential of the spectra with the same sign, and "0" for the differential of the spectra with reverse signs, for instance. Also, the information indicating the direction on the frequency axis of copying the spectrum in the lower frequency band to the higher frequency band is represented by 1 bit, "1", for the forward copying direction, that is, the forward direction of selecting the spectral data in the higher and lower frequency bands, and "0" for the reverse copying direction, that is, the reverse direction of selecting the spectral data in the higher and lower frequency bands, for instance.

In the above, the case where the audio data distribution system according to the present embodiment is applied to the broadcast system has been explained. However, it may be applied to such an audio data distribution system that distributes audio data in a bit stream from a server to a terminal via a transmission medium such as the Internet. Or it may be applied to such an audio data distribution system that once recodes the bit stream outputted from the encoding device 300 on a recording medium such as an optical disc including CD and DVD, a semiconductor, or a hard disk and then reproduce it in the decoding device 400 via this recording medium.

In the present embodiment, the processing is performed using a LONG block, but it may be performed using a SHORT block. The same processing can be performed using a SHORT block as a LONG block.

In the encoding processing, tools such as Gain Control, TNS (Temporal Noise Shaping), a psychoacoustic model, M/S Stereo, Intensity Stereo and Prediction, a change of a block size, a bit reservoir, etc. may be used.

In the present embodiment, the sub information is generated based on the spectral data in the higher frequency band divided by the data dividing unit 330. However, the sub information may be generated based on the value obtained by dequantizing the output from the first quantizing unit 340, as the spectral data in the higher frequency band.

In the present embodiment, a scale factor for deriving a quantized value "1" of spectral data in each scale factor band in the higher frequency band, the quantized value, position information of a characteristic spectrum, sign information indicating the positive or negative sign of the spectrum, and so on are used as sub information. However, a combination of two or more of them may be the sub information. In this case, if a combination of the scale factor and a coefficient indicating a gain, a position of the absolute maximum spectral data, etc. is encoded in the sub information, it is particularly effective. Also, one sub information is encoded for each scale factor band as the second encoded signal in the present embodiment, but one sub information may be encoded for two or more scale factor bands, or two or more sub information may be encoded for one scale factor band. In addition, the sub information in the present embodiment may be encoded for every channel, or one sub information may be encoded for two or more channels.

In the present embodiment, the encoding device 300 includes two quantizing units and two encoding units. However, the present invention is not limited to that, and it may include three or more quantizing units and encoding units, respectively.

In the present embodiment, the decoding device 400 includes two decoding units and two dequantizing units. However, the present invention is not limited to that, and it may include three or more decoding units and dequantizing units, respectively.

The above-mentioned processing can be realized by software as well as hardware, and the present invention may be configured so that a part of the processing is realized by hardware and the other processing is realized by software.

In the present embodiment, the sampling frequency of 44.1 kHz is used, but other sampling frequencies such as 32 kHz or 48 kHz may be used. And the frequency as a boundary for the division of the spectral data by the data dividing unit 330 may be changed to any other frequencies than 11.025 kHz.

Furthermore, in the present embodiment, the processing is performed in accordance with MPEG-2 AAC. However, the same processing may be performed in an encoding device, a decoding device and others in accordance with other methods (MP3, AC3, etc., for instance).

Furthermore, the encoding device according to the present invention may be structured as follows.

The encoding device according to the present invention is an encoding device that encodes audio data, and may include: a splitting unit operable to split an audio data string into m2 samples, more than a requested number of samples m1, of contiguous audio data from the generated audio data string; a transforming unit operable to transform the audio data split by the splitting unit into spectral data in the frequency domain; a dividing unit operable to divide m2 samples of the spectral data obtained by the transformation into m1 samples of spectral data in the lower frequency band and (m2−m1) samples of spectral data in the higher frequency band; a lower frequency band encoding unit operable to quantize the divided spectral data in the lower frequency band and encode the quantized data; a sub information generating unit operable to generate sub information indicating a characteristic of the frequency spectrum in the higher frequency band from the divided spectral data in the higher frequency band; a higher frequency band encoding unit operable to encode the generated sub information; and an outputting unit operable to integrate the code obtained by the lower frequency band encoding unit and the code obtained by the higher frequency band encoding unit, and output the integrated sign.

In this case, the sub information generating unit may be structured so as to calculate a normalizing factor for deriving a fixed value that is a value obtained by quantizing peak spectral data in each group in the higher frequency band for the spectral data which is divided into a plurality of the groups, and generate the calculated normalizing factor as the sub information.

Also, the sub information generating unit may be structured so as to quantize the peak spectral data in each group in the higher frequency band, using the normalizing factor common to each group, for the spectral data which is divided into a plurality of the groups, and generate the quantized value as the sub information.

Also, the sub information generating unit may be structured so as to generate a frequency position of the peak spectral data in each group in the higher frequency band, as the sub information, for the spectral data which is divided into a plurality of the groups.

Also, the spectral data is an MDCT coefficient, and the sub information generating unit may be structured so as to generate a sign indicating positive and negative of the spectral data at a predetermined frequency position in the higher frequency band, as the sub information, for the spectral data which is divided into a plurality of the groups.

Furthermore, the sub information generating unit may be structured so as to generate information specifying a spectrum in the lower frequency band which is most approximate to the spectrum in each of the group in the higher frequency band, as the sub information, for the spectral data which is divided into a plurality of the groups. In this case, the sub information generating unit may be structured so as to specify a spectrum in the lower frequency band in which a difference between the distance on the frequency axis from the delimiter of the group in the higher frequency band to the peak of the spectrum in that group and the distance on the frequency axis from the delimiter of the group in the lower frequency band to the peak of the spectrum in that group is minimum. Also, the sub information generating unit may be structured so as to specify a spectrum in the lower frequency band energy differential value obtained in the same frequency bandwidth as the spectrum in the group in the higher frequency band is minimum. Also, the information specifying the spectrum in the lower frequency band is a number specifying the group of the specified spectrum in the lower frequency band.

Also, the sub information generating unit may be structured so as to generate a predetermined coefficient indicating the gain of the amplitude of the spectrum in the higher frequency band, as the sub information.

Also, the outputting unit may further include a stream outputting unit operable to transform the data encoded by the lower frequency band encoding unit into an encoded audio stream defined in a predetermined format, to store the data encoded by the higher frequency band encoding unit in an area in the encoded audio stream whose use is not limited under the encoding protocol, and to output the stored data. In this case, the stream outputting unit may be structured so as to write information indicating f1 Hz as a sampling frequency.

Furthermore, the outputting unit may further include a second stream outputting unit operable to transform the data encoded by the lower frequency band encoding unit into an encoded audio stream defined in a predetermined format, to store the data encoded by the higher frequency band encoding unit in a stream different from the encoded audio stream, and to output the stored data.

Note that the present invention can, of course, be realized as a communication system including the encoding device and the decoding device of the above-mentioned variation, as an encoding method or a communication method of causing the characteristic units included in the above-mentioned encoding device and the communication system to function as the steps, as an encoding program for causing CPU to execute the characteristic units or steps of the above-mentioned encoding device, or as a computer-readable recording medium on which this program is recorded.

INDUSTRIAL APPLICABILITY

The encoding device according to the present invention is suitable for use as a distribution system for distributing contents such as music in a stream or via a recording medium.

The invention claimed is:

1. An encoding device that encodes audio data comprising:

a splitting unit operable to split an audio data string into a fixed number of contiguous audio data;

a transforming unit operable to transform the split audio data into spectral data in a frequency domain;

a dividing unit operable to divide the spectral data obtained by the transforming unit into a plurality of groups of spectral data, and to divide the spectral data which are divided into groups into spectral data in a lower frequency band of f1 Hz and less and spectral data in a higher frequency band over f1 Hz;

a lower frequency band encoding unit operable to quantize and encode each group of the divided spectral data in the lower frequency band;

a sub information generating unit operable to generate, for each group of spectral data in the higher frequency band, information specifying a spectrum of spectral data in the lower frequency band which is most approximate to the spectrum in each group of spectral data in the higher frequency band as sub information indicating a characteristic of a spectrum in each group of spectral data in the higher frequency band;

a higher frequency band encoding unit operable to encode the generated sub information; and an outputting unit operable to integrate the encoded data obtained by the lower frequency band encoding unit and the encoded sub information obtained by the higher frequency band encoding unit, and output the integrated result, wherein f1 is a half or less of a sampling frequency f2 for the audio data string.

2. The encoding device according to claim 1, wherein the sub information generating unit specifies a spectrum in the lower frequency band in which a difference between (1) a distance in a frequency domain from a delimiter of each group in the higher frequency band to a peak of the spectrum in that group and (2) a distance in the frequency domain from a delimiter of each group in the lower frequency band to a peak of the spectrum in that group is minimum.

3. The encoding device according to claim 1, wherein the sub information generating unit specifies a spectrum in the lower frequency band whose differential value of energy obtained in a same frequency bandwidth as that of the spectrum in the group in the higher frequency band is minimum.

4. The encoding device according to claim 1, wherein the information specifying the spectrum in the lower frequency band is a number specifying the group of the specified spectrum in the lower frequency band.

5. The encoding device according to claim 1, wherein the sub information generating unit generates a coefficient indicating a gain of amplitude of the spectrum in the higher frequency band, as the sub information.

6. The encoding device according to claim 1, wherein the outputting unit further includes a stream outputting unit operable to transform the data encoded by the lower frequency band encoding unit into an encoded audio stream defined in a predetermined format, position the data encoded by the higher frequency band encoding unit in an area in the encoded audio stream whose use is not limited under the predetermined format, and output the data.

7. The encoding device according to claim 6, wherein the stream outputting unit outputs information indicating f2/2 Hz as a sampling frequency.

8. The encoding device according to claim 1, wherein the outputting unit further includes a stream outputting unit operable to transform the data encoded by the lower frequency band encoding unit into an encoded audio stream defined in a predetermined format, and output the data encoded by the higher frequency band encoding unit in a stream different from the encoded audio stream.

9. A decoding device that decodes inputted encoded data, comprising:

an extracting unit operable to extract lower frequency band encoded data and higher frequency band encoded data included in the inputted encoded data;

a lower frequency band dequantizing unit operable to decode and dequantize the lower frequency band encoded data into spectral data in a lower frequency band of f1 Hz and less;

a sub information decoding unit operable to decode the higher frequency band encoded data into plural pieces of sub information each representing a group of spectral data of a corresponding bandwidth in a higher frequency band over fl Hz each piece of sub information specifying spectral data in the lower frequency band having a spectrum which is most approximate to a spectrum of each group of spectral data in the higher frequency band;

a higher frequency band dequantizing unit operable to copy, to the higher frequency band bandwidth corresponding to the group of spectral data represented by the piece of sub information, the spectral data in the lower frequency band specified by the piece of sub information;

an integrating unit operable to integrate the spectral data in the lower frequency band decoded by the lower frequency band dequantizing unit and the spectral data in the higher frequency band decoded by the higher frequency band dequantizing unit;

an inverse-transforming unit operable to inversely transform the spectral data integrated by the integrating unit into audio data in a time domain; and an audio data outputting unit operable to output the audio data which is inversely transformed by the inverse-transforming unit on a time series basis.

10. The decoding device according to claim 9, wherein the higher frequency band dequantizing unit generates a predetermined noise in the bandwidth corresponding to said each group in the higher frequency band based on the sub information, and generates the spectral data in the higher frequency band by adding the generated noise to the copied spectral data.

11. An audio data distribution system for distributing audio data which is compressed and encoded into a bit stream at a low bit rate via a recording medium or a transmission medium, the system comprising an encoding device and a decoding device:

wherein the encoding device encodes audio data, and includes:

a splitting unit operable to split an audio data string into a fixed number of contiguous audio data;

a transforming unit operable to transform the split audio data into spectral data in a frequency domain;

a dividing unit operable to divide the spectral data obtained by the transforming unit into spectral data in the lower frequency band of f1 Hz and less and spectral data in a higher frequency band over f1 Hz;

a lower frequency band encoding unit operable to quantize the divided spectral data in the lower frequency band and encode the quantized data;

a sub information generating unit operable to generate sub information indicating a characteristic of a frequency spectrum in the higher frequency band from the divided spectral data in the higher frequency band;

a higher frequency band encoding unit operable to encode the generated sub information; and an outputting unit operable to integrate a code obtained by the lower frequency band encoding unit and a code obtained by the higher frequency band encoding unit, and output the integrated code, wherein the f1 is a half or less of a sampling frequency f2 at which the audio data string is created, and the decoding device decodes encoded data inputted via a recording medium or a transmission medium, and includes:

an extracting unit operable to extract lower frequency band encoded data and higher frequency band encoded data included in encoded data;

a lower frequency band dequantizing unit operable to decode and dequantize the lower frequency band encoded data extracted by the extracting unit, and thereby output spectral data in a lower frequency band of f1 Hz and less;

a sub information decoding unit operable to decode the higher frequency band encoded data extracted by the extracting unit, and thereby generate sub information indicating a characteristic of spectral data in a higher frequency band;

a higher frequency band dequantizing unit operable to output the spectral data in the higher frequency band based on the sub information generated by the sub information decoding unit;

an integrating unit operable to integrate the spectral data in the lower frequency band outputted by the lower frequency band dequantizing unit and the spectral data in the higher frequency band outputted by the higher frequency band dequantizing unit;

an inverse-transforming unit operable to inversely transform the spectral data integrated by the integrating unit into audio data in a time domain;

an audio data outputting unit operable to output the audio data which is inversely transformed by the inverse-transforming unit on a time series basis.

12. An encoding method for encoding audio data, said method comprising:

splitting an audio data string into a fixed number of contiguous audio data;

transforming the split audio data into spectral data in a frequency domain;

dividing the spectral data into a plurality of groups of spectral data, and dividing the spectral data which are divided into groups into spectral data in a lower frequency band of f1 Hz and less and spectral data in a higher frequency band over f1 Hz;

quantizing and encoding each group of the divided spectral data in the lower frequency band;

generating, for each group of spectral data in the higher frequency band, information specifying a spectrum of spectral data in the lower frequency band which is most approximate to the spectrum in each group of spectral data in the higher frequency band as sub information indicating a characteristic of a spectrum in each group of spectral data in the higher frequency band;

encoding the generated sub information; and integrating the encoded data and the encoded sub information, and outputting the integrated result, wherein f1 is a half or less of a sampling frequency f2 for the audio data string.

13. A decoding method for decoding inputted encoded data, said method comprising:

extracting lower frequency band encoded data and higher frequency band encoded data included in the inputted encoded data;

decoding and dequantizing the lower frequency band encoded data into spectral data in a lower frequency band of f1 Hz and less;

decoding the higher frequency band encoded data into plural pieces of sub information each representing a group of spectral data of a corresponding bandwidth in a higher frequency band over f1 Hz, each piece of sub information specifying spectral data in the lower frequency band having a spectrum which is most approximate to a spectrum of each group of spectral data in the higher frequency band;

copying, to the higher frequency band bandwidth corresponding to the group of spectral data represented by the piece of sub information, the spectral data in the lower frequency band specified by the piece of sub information;

integrating the decoded spectral data in the lower frequency band and the decoded spectral data in the higher frequency band;

inverse-transforming the integrated spectral data into audio data in a time domain; and outputting the inversely transformed audio data on a time series basis.

14. A computer readable medium having embodied thereon a computer program for causing an encoding device to perform an audio data encoding method comprising:

splitting an audio data string into a fixed number of contiguous audio data;

transforming the split audio data into spectral data in a frequency domain;

dividing the spectral data into a plurality of groups of spectral data, and dividing the spectral data which are divided into groups into spectral data in a lower frequency band of f1 Hz and less and spectral data in a higher frequency band over f1 Hz;

quantizing and encoding each group of the divided spectral data in the lower frequency band;

generating, for each group of spectral data in the higher frequency band, information specifying a spectrum of spectral data in the lower frequency band which is most approximate to the spectrum in each group of spectral data in the higher frequency band as sub information indicating a characteristic of a spectrum in each group of spectral data in the higher frequency band;

encoding the generated sub information; and integrating the encoded data and the encoded sub information, and outputting the integrated result, wherein f1 is a half or less of a sampling frequency f2 for the audio data string.

15. A computer readable medium having embodied thereon a computer program for causing a decoding device to perform an audio data decoding method comprising:

extracting lower frequency band encoded data and higher frequency band encoded data included in the inputted encoded data;

decoding and dequantizing the lower frequency band encoded data into spectral data in a lower frequency band of f1 Hz and less;

decoding the higher frequency band encoded data into plural pieces of sub information each representing a group of spectral data of a corresponding bandwidth in a higher frequency band over f1 Hz, each piece of sub information specifying spectral data in the lower frequency band having a spectrum which is most approximate to a spectrum of each group of spectral data in the higher frequency band;

copying, to the higher frequency band bandwidth corresponding to the group of spectral data represented by the piece of sub information, the spectral data in the lower frequency band specified by the piece of sub information;

integrating the decoded spectral data in the lower frequency band and the decoded spectral data in the higher frequency band;

inverse-transforming the integrated spectral data into audio data in a time domain; and outputting the inversely transformed audio data on a time series basis.

* * * * *

UNITED STATES PATENT AND TRADEMARK OFFICE

CERTIFICATE OF CORRECTION

PATENT NO. : 7,392,176 B2
APPLICATION NO. : 10/285627
DATED : June 24, 2008
INVENTOR(S) : Kosuke Nishio et al.

It is certified that error appears in the above-identified patent and that said Letters Patent is hereby corrected as shown below:

ON THE TITLE PAGE, ITEM [30]

In column 1, line 17, "Nov. 20, 2001" should read --Nov. 2, 2001--.

IN THE CLAIMS

In column 33, claim 9, line 63, "over f1 Hz each piece" should read --over f1 Hz, each piece--.

In column 34, claim 11, line 26, delete

"An audio data distribution system for distributing audio data which is compressed and encoded into a bit stream at a low bit rate via a recording medium or a transmission medium, the system comprising an encoding device and a decoding device: wherein the encoding device encodes audio data, and includes:

a splitting unit operable to split an audio data string into a fixed number of contiguous audio data;

a transforming unit operable to split an audio data into spectral data in a frequency domain;

a dividing unit operable to divide the spectral data obtained by the transforming unit into spectral data in the lower frequency band of f1 Hz and less and spectral data in a higher frequency band over f1 Hz;

a lower frequency band encoding unit operable to quantize the divided spectral data in the lower frequency band and encode the quantized data;

a sub information generating unit operable to generate sub information indicating a characteristic of a frequency spectrum in the higher frequency band;

It is certified that error appears in the above-identified patent and that said Letters Patent is hereby corrected as shown below:

a higher frequency band encoding unit operable to encode the generated sub information; and an outputting unit operable to integrate a code obtained by the lower frequency band encoding unit and a code obtained by the higher frequency band encoding unit, and the output the integrated code, wherein the f1 is a half or less of a sampling frequency f2 at which the audio data string is created, and the decoding device decodes encoded data inputted via a recoding medium or a transmission medium, and includes:

an extracting unit operable to extract lower frequency band encoded data and higher frequency band encoded data included in encoded data;

a lower frequency band dequantizing unit operable to decode and dequantize the lower frequency band encoded data extracted by the extracting unit, and thereby output spectral data in a lower frequency band of f1 Hz and less;

sub information decoding unit operable to decode the higher frequency band encoded data extracted by the extracting unit, and thereby generate sub information indicating a characteristic of spectral data in a higher frequency band;

a higher frequency band dequantizing unit operable output the spectral data in the higher frequency band based on the sub information generated by the sub information decoding unit;

an integrating unit operable to integrate the spectral data in the lower frequency band outputted by the lower frequency band dequantizing unit and the spectral data in the higher frequency outputted by the higher band dequantizing unit;

an inverse-transforming unit operable to inversely transform the spectral data integrated by the integrating unit into audio data in a time domain;

an audio data outputting unit operable to output the audio data which is inversely transformed by the inverse-transforming unit on a time series basis." should read

UNITED STATES PATENT AND TRADEMARK OFFICE

CERTIFICATE OF CORRECTION

PATENT NO. : 7,392,176 B2
APPLICATION NO. : 10/285627
DATED : June 24, 2008
INVENTOR(S) : Kosuke Nishio et al.

It is certified that error appears in the above-identified patent and that said Letters Patent is hereby corrected as shown below:

--An audio data distribution system comprising:

an encoding device that encodes audio data, said encoding device comprising:

a splitting unit operable to split an audio data string into a fixed number of contiguous audio data;

a transforming unit operable to transform the split audio data into spectral data in a frequency domain;

a dividing unit operable to divide the spectral data obtained by the transforming unit into a plurality of groups of spectral data, and to divide the spectral data which are divided into groups into spectral data in a lower frequency band of f1 Hz and less and spectral data in a higher frequency band over f1 Hz;

a lower frequency band encoding unit operable to quantize and encode each group of the divided spectral data in the lower frequency band;

a sub information generating unit operable to generate, for each group of spectral data in the higher frequency band, information specifying a spectrum of spectral data in the lower frequency band which is most approximate to the spectrum in each group of spectral data in the higher frequency band as sub information indicating a characteristic of a spectrum in each group of spectral data in the higher frequency band; a sub information generating unit operable to generate, for each group of spectral data in the higher frequency band, information specifying a spectrum of spectral data in the lower frequency band which is most approximate to the spectrum in each group of spectral data in the higher frequency band as sub information indicating a characteristic of a spectrum in each group of spectral data in the higher frequency band;

a higher frequency band encoding unit operable to encode the generated sub information; and

UNITED STATES PATENT AND TRADEMARK OFFICE

CERTIFICATE OF CORRECTION

PATENT NO. : 7,392,176 B2
APPLICATION NO. : 10/285627
DATED : June 24, 2008
INVENTOR(S) : Kosuke Nishio et al.

It is certified that error appears in the above-identified patent and that said Letters Patent is hereby corrected as shown below:

an outputting unit operable to integrate the encoded data obtained by the lower frequency band encoding unit and the encoded sub information obtained by the higher frequency band encoding unit, and output the integrated result as encoded data, wherein f1 is a half or less of a sampling frequency f2 for the audio data string; and a decoding device that decodes the encoded data outputted by said outputting unit of said encoding device, said decoding device comprising:

an integrating unit operable to integrate the spectral data in the lower frequency band decoded by the lower frequency band dequantizing unit and the spectral data in the higher frequency band decoded by the higher frequency band dequantizing unit;

an inverse-transforming unit operable to inversely transform the spectral data integrated by the integrating unit into audio data in a time domain; and an audio data outputting unit operable to output the audio data which is inversely transformed by the inverse-transforming unit on a time series basis.--.

Signed and Sealed this

Twenty-fifth Day of November, 2008

JON W. DUDAS
*Director of the United States Patent and Trademark Office*